US009828564B2

(12) United States Patent
West

(10) Patent No.: US 9,828,564 B2
(45) **Date of Patent: *Nov. 28, 2017**

(54) NON-AQUEOUS LUBRICANT AND FUEL COMPOSITIONS COMPRISING FATTY ACID ESTERS OF HYDROXY-CARBOXYLIC ACIDS, AND USES THEREOF

(71) Applicant: CASTROL LIMITED, Wiltshire (GB)

(72) Inventor: Kevin Richard West, Reading (GB)

(73) Assignee: Castrol Limited, Reading (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/813,564

(22) Filed: Jul. 30, 2015

(65) Prior Publication Data

US 2015/0337229 A1 Nov. 26, 2015

Related U.S. Application Data

(63) Continuation of application No. 13/823,790, filed as application No. PCT/GB2011/001510 on Oct. 20, 2011, now Pat. No. 9,127,232.

(30) Foreign Application Priority Data

Oct. 26, 2010 (EP) ..... 10251848

(51) Int. Cl.

| | |
|---|---|
| ***C10M 129/82*** | (2006.01) |
| ***C10M 129/80*** | (2006.01) |
| ***C10M 129/78*** | (2006.01) |
| ***C10M 129/72*** | (2006.01) |
| ***C10L 1/19*** | (2006.01) |
| ***C10L 10/08*** | (2006.01) |
| ***C10M 129/70*** | (2006.01) |
| ***C10M 129/76*** | (2006.01) |

(52) U.S. Cl.

CPC ..... *C10M 129/72* (2013.01); *C10L 1/19* (2013.01); *C10L 1/1915* (2013.01); *C10L 10/08* (2013.01); *C10M 129/70* (2013.01); *C10M 129/76* (2013.01); *C10M 129/78* (2013.01); *C10M 2207/281* (2013.01); *C10M 2207/285* (2013.01); *C10M 2207/288* (2013.01); *C10M 2207/30* (2013.01); *C10N 2230/06* (2013.01); *C10N 2240/10* (2013.01)

(58) Field of Classification Search

CPC ..... C10M 129/72; C10M 129/70; C10M 129/76; C10M 129/78; C10M 2207/281; C10M 2207/288; C10M 2207/30; C10M 2207/285; C10L 10/08; C10L 1/19; C10L 1/1915; C10N 2230/06; C10N 2240/10; C07C 59/00; C07C 59/01; C07C 59/06; C07C 59/08; C07C 59/10; C07C 59/105; C07C 59/235; C07C 59/245; C07C 59/255; C07C 59/265; C07C 59/40; C07C 59/42; C07C 59/44

See application file for complete search history.

(56) References Cited

U.S. PATENT DOCUMENTS

| | | | | |
|---|---|---|---|---|
| 3,826,675 | A | 7/1974 | Smith et al. | |
| 3,933,659 | A | 1/1976 | Lyle et al. | |
| 3,970,570 | A | 7/1976 | Pratt et al. | |
| 4,304,678 | A | 12/1981 | Schick et al. | |
| 4,375,360 | A | 3/1983 | Washecheck et al. | |
| 4,376,711 | A | 3/1983 | Shaub | |
| 4,609,376 | A | 9/1986 | Craig et al. | |
| 4,764,296 | A | 8/1988 | Kennedy | |
| 4,820,431 | A | 4/1989 | Kennedy | |
| 5,260,466 | A | 11/1993 | McGibbon | |
| 5,338,470 | A | 8/1994 | Hiebert et al. | |
| 5,458,795 | A | 10/1995 | Lawate | 508/481 |
| 5,665,683 | A | 9/1997 | Froeschmann | |
| 5,770,185 | A | 6/1998 | Wachter et al. | |

(Continued)

FOREIGN PATENT DOCUMENTS

| | | | |
|---|---|---|---|
| CA | 1 120 023 | | 3/1982 |
| CA | 2 067 023 | | 11/1992 |
| CN | 1453346 | A | 11/2003 |
| CN | 1611589 | A | 5/2005 |
| EP | 0 092 946 | A2 | 11/1983 |

(Continued)

OTHER PUBLICATIONS

EIC Search Oct. 20, 2016.*

Thiel, C.Y., et al; "The Fuel Additive/Lubricant Interactions: Compatibility Assessments in Field Studies and Laboratory Tests"; *SAE Technical Pater Series*, (14 pgs), 2001-01-1962.

ACS Registry Copyright 2010 ACS on STN; Entered STN: Dec. 26, 2007 (1 pg); Database: NIST Chemistry WebBook (National Institute of Standards and Technology).

Grindsted® Citrem N 12 Veg Kosher, Product Description—PD 154-12.3EN, Material No. 093224, (2 pgs)—Danisco—publication date unknown but received Feb. 3, 2009.

(Continued)

*Primary Examiner* — Pamela H Weiss

(74) *Attorney, Agent, or Firm* — McDonnell Boehnen Hulbert & Berghoff LLP

(57) ABSTRACT

The use as an anti-wear additive and/or friction modifier in a non-aqueous lubricant composition and/or in a fuel composition of at least one long chain fatty acid ester of a hydroxy carboxylic acid in which the long chain fatty acid has at least 4 carbon atoms and the ester is an oil-soluble ester of a mono- or poly-hydroxy carboxylic acid having 1 to 4 groups which are independently carboxylic acid groups or lower hydrocarbyl esters thereof and in which, when the hydroxy carboxylic acid is a mono-hydroxy carboxylic acid, the ester has a long chain fatty acid ester moiety of the hydroxy group of the hydroxy carboxylic acid and, when the hydroxy carboxylic acid is a poly-hydroxy carboxylic acid, the ester has independently long chain fatty acid ester moieties of one or two of the hydroxy groups of the poly-hydroxy carboxylic acid. Also, a non-aqueous lubricant composition and a fuel composition for an internal combustion engine which comprises at least one of said long chain fatty acid esters.

24 Claims, No Drawings

(56) References Cited

U.S. PATENT DOCUMENTS

| | | | | |
|---|---|---|---|---|
| 5,993,498 | A | 11/1999 | Vrahopoulou et al. | |
| 6,150,575 | A | 11/2000 | Angevine et al. | |
| 6,831,107 | B2 | 12/2004 | Dederen et al. | |
| 6,843,916 | B2 | 1/2005 | Burrington et al. | |
| 7,256,162 | B2 | 8/2007 | Pollock et al. | |
| 7,651,987 | B2 | 1/2010 | Kocsis et al. | |
| 7,678,747 | B2 | 3/2010 | Roby et al. | |
| 7,696,136 | B2 * | 4/2010 | Migdal | C10L 1/19 44/388 |
| 7,807,611 | B2 | 10/2010 | Kocsis et al. | |
| 9,080,120 | B2 * | 7/2015 | Adams | C10L 1/191 |
| 9,127,232 | B2 * | 9/2015 | West | C10L 1/19 |
| 2003/0069146 | A1 | 4/2003 | Garmier | |
| 2003/0220208 | A1 | 11/2003 | Lantuejoul et al. | |
| 2005/0070449 | A1 | 3/2005 | Roby et al. | |
| 2005/0070450 | A1 | 3/2005 | Roby et al. | |
| 2005/0198894 | A1 | 9/2005 | Migdal et al. | |
| 2006/0090393 | A1 | 5/2006 | Rowland et al. | |
| 2008/0176778 | A1 | 7/2008 | Seemeyer et al. | |
| 2009/0011964 | A1 | 1/2009 | Wen et al. | |
| 2009/0082236 | A1 | 3/2009 | Wen et al. | |
| 2009/0152502 | A1 | 6/2009 | Muller et al. | |
| 2009/0197783 | A1 | 8/2009 | Roby et al. | |
| 2010/0081592 | A1 | 4/2010 | Kocsis et al. | |
| 2010/0087319 | A1 | 4/2010 | Mainx et al. | |
| 2010/0093573 | A1 * | 4/2010 | Kocsis | C10M 141/06 508/287 |
| 2010/0173812 | A1 | 7/2010 | Kocsis et al. | |
| 2010/0197536 | A1 | 8/2010 | Mosier et al. | |
| 2010/0210487 | A1 | 8/2010 | Deblase et al. | |
| 2010/0222245 | A1 | 9/2010 | Kocsis et al. | |
| 2010/0227784 | A1 | 9/2010 | Kocsis et al. | |
| 2011/0059877 | A1 | 3/2011 | Obiols et al. | 508/186 |
| 2011/0131868 | A1 | 6/2011 | Kocsis et al. | |

FOREIGN PATENT DOCUMENTS

| | | | | |
|---|---|---|---|---|
| EP | 1 533 362 | A1 | | 5/2005 |
| FR | 2 924 439 | A1 | | 6/2009 |
| GB | 2 097 813 | A | | 11/1982 |
| JP | 07268369 | A | * | 10/1995 |
| WO | WO 93/21288 | A1 | | 10/1993 |
| WO | WO 94/17160 | A1 | | 8/1994 |
| WO | WO 00/33806 | A1 | | 6/2000 |
| WO | WO 2005/087904 | A2 | | 9/2005 |
| WO | WO 2006/044411 | A1 | | 4/2006 |
| WO | WO 2007/092724 | A2 | | 8/2007 |
| WO | WO 2007/148047 | A1 | | 12/2007 |
| WO | WO 2008/008864 | A2 | | 1/2008 |
| WO | WO 2008/032284 | A2 | | 3/2008 |
| WO | WO 2008/067259 | A1 | | 6/2008 |
| WO | WO 2008/070307 | A2 | | 6/2008 |
| WO | WO 2008/124191 | A1 | | 10/2008 |
| WO | WO 2008/135602 | A2 | | 11/2008 |
| WO | WO 2008/139142 | A1 | | 11/2008 |
| WO | WO 2008/147700 | A1 | | 12/2008 |
| WO | WO 2008/147701 | A1 | | 12/2008 |
| WO | WO 2008/147704 | A1 | | 12/2008 |
| WO | WO 2009/101276 | A1 | | 8/2009 |
| WO | WO 2009101276 | A1 | | 8/2009 |
| WO | WO 2010/005921 | A1 | | 1/2010 |
| WO | WO 2010/053893 | A1 | | 5/2010 |
| WO | WO 2010/093519 | A1 | | 8/2010 |
| WO | WO 2010/104609 | A2 | | 9/2010 |
| WO | WO 2010/112158 | A1 | | 10/2010 |
| WO | WO 2011/005635 | A1 | | 1/2011 |
| WO | WO 2012/056191 | A1 | | 5/2012 |

OTHER PUBLICATIONS

Grindsted Citrem SP 70 Kosher, Product Description—PD 562-14. 3EN, Material No. 172734, (2 pgs)—Danisco—publication date unknown but received Feb. 3, 2009.

Aditiva ingredients & specialties—product sheet (2 pgs), date unknown.

Ponomarenko, G.G., et al; "Research of tribo-chemical processes with the involvement of complex hydrocarboxylic acids ester"; *Fraction and wear and tear*, vol. 9, No. 2, Mar.-Apr. 1988, pp. 305-310 (with translation).

Citrate—Wikipedia, the free encyclopedia webpage, http://en.wikipedia.org/wiki/Citrate, (2pgs), May 28, 2009.

Tartarate—Wikipedia, the free encyclopedia webpage, http://en.wikipedia.org/wiki/Tartrate, (1 pg), May 28, 2009.

Diglyceride—Wikipedia, the free encyclopedia webpage, http://en.wikipedia.org/wiki/Diglyceride, (3pgs), Feb. 12, 2010.

Citric acid esters—Danisco A/S webpage, http://danisco.dk/wps/wcm/connect/danisco/corporate/products+and+services/ . . . , (2 pgs), Jan. 20, 2010.

Intl Search Report and the Written Opinion of the Intl Searching Authority; Form PCT/ISA/220; PCT/GB2011/000934; Int'l Filing Date Jun. 21, 2011 (9 pgs) as filed in Co-pending U.S. Appl. No. 13/701,965, filed Dec. 4, 2012.

* cited by examiner

NON-AQUEOUS LUBRICANT AND FUEL COMPOSITIONS COMPRISING FATTY ACID ESTERS OF HYDROXY-CARBOXYLIC ACIDS, AND USES THEREOF

This application is a continuation of application Ser. No. 13/823,790 filed Mar. 15, 2013 which is a 371 of PCT/GB2011/001510, filed Oct. 20, 2011, which claims priority to European Patent Application No. 10251848.7, filed 26 Oct. 2010, the entire contents of each of which are hereby incorporated by reference.

This invention relates to anti-wear additives and friction modifiers and their use in lubricant compositions and fuel compositions.

It is known to use anti-wear additives and/or friction modifiers in lubricant compositions. It is also known to use anti-wear additives and/or friction modifiers in fuel compositions for internal combustion engines.

The ingress of fuel and fuel additives into the crankcase lubricant of an internal combustion engine is known, for example from paragraph 2 of the abstract of SAE paper 2001-01-1962 by C. Y. Thiel et al. "The Fuel Additive/lubricant Interactions: . . . ."

Zinc dihydrocarbyl dithiophosphates (ZDDP) have been used as anti-wear additives in lubricant compositions for many years. A disadvantage of these additives is that, when used to lubricate internal composition engines, they give rise to ash which contributes to particulate matter in the exhaust emissions from the internal combustion engines. It is therefore desirable to reduce the amount of ash-forming additives used for lubricating internal combustion engines. It is also desirable to reduce the amount of zinc and/or phosphorus and/or sulphur in the exhaust emissions from internal combustion engines. Attempts have therefore been made to provide anti-wear additives and/or friction modifiers which contain neither zinc nor phosphorus nor sulphur, or at least contain them in reduced amounts.

British patent application publication GB-2097813-A relates to fuel economy promoting lubricating oil compositions which comprise an oil of lubricating viscosity and, as the fuel economy additive, from 0.05 to 0.2 weight percent of a glycerol partial ester of a $C_{16}$-$C_{18}$ fatty acid. The composition is illustrated with glycerol monooleate and glycerol dioleate.

International patent application publication WO 2008/147704 relates to a lubricating composition containing an oil of lubricating viscosity, an oil soluble molybdenum compound and an ashless antiwear agent of a defined formula (I). According to WO 2008/147704, (para. [0042]) in one embodiment the ashless antiwear agent includes a compound derived from a hydroxycarboxylic acid. It is stated (para. [0048]) that in one embodiment the ashless agent includes imide, di-esters, di-imides, ester-amide derivatives of tartaric acid. It is also stated (para. [0049]) that examples of suitable citric acid derivative[s] include trialkyl citrates or borated trialkyl citrates. It is stated (para. [0049]) that a more detailed description of suitable citrates is disclosed in WO 2005/087904 and U.S. Pat. No. 5,338,470.

International patent application publication WO 2005/087904 related to US 2005/0198894 relates to lubricant and fuel compositions containing hydroxy carboxylic acid and hydroxy polycarboxylic acid esters represented by the generic formula:

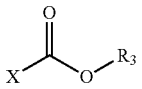

wherein $R_3$ is selected from the group consisting of $C_1$-$C_{18}$ linear or branched alkyl, $C_1$-$C_{18}$ linear or branched alkenyl, alkoxyalkyl, hydroxyalkyl, aryl, and benzyl; and X— is selected from a range of structures defined therein. Preferred esters are said to include citrates, tartrates, malates, lactates, mandelates, glycolates, hydroxy propionates, hydroxyglutarates, salicylates and the like. Trialkyl citrates and borated trialkyl citrates are said to be especially preferred, particularly triethyl citrate and borated triethyl citrate. A particularly preferred class of additives is said to be one wherein $R_3$ is a linear or branched alkyl chain of 1 to 5 carbon atoms, e.g., methyl, ethyl, propyl, butyl, pentyl, isomers of the foregoing, and mixtures thereof.

U.S. Pat. No. 5,338,470 relates to alkylated citric acid adducts as antiwear and friction modifying additives for fuels and lubricant compositions. The alkylated citric acid adducts are said to be formed by the reaction of citric acid with alkyl alcohols and amines. The reaction is described using nXRy where R is said to be $C_{1-200}$ hydrocarbyl or hydrocarbylene or a mixture thereof, and may optionally contain oxygen, nitrogen or sulphur. "X" is said to be an amine, alcohol, thiol or a metal amide, alkoxide or thiolate. The metal is said to be preferably sodium, potassium or calcium and "n" is a number from 0.2-5.0. Such additives are illustrated only by the reaction of citric acid and oleyl alcohol.

According to WO 2008/147704 the [composition] further comprises a friction modifier (para. [0089]). According to paragraph [0093]: "In one embodiment the friction modifier is a long chain fatty acid ester (previously described above as an ashless antiwear agent). In another embodiment the long chain fatty acid ester is a mono-ester and in another embodiment the long chain fatty acid ester is a (tri)glyceride."

International patent application publication WO 2009/101276 relates to a lubricant composition for a four stroke engine with low ash content which is said to comprise amongst other components, at least one hydroxylated ester of the formula $R(OH)_m,(COOR'(OH)_p)_n$ in which in is an integer from 0 to 8, preferably from 1 to 4, n is an integer from 1 to 8, preferably from 1 to 4, and p is an integer from 0 to 8, preferably from 1 to 4, wherein the sum p+m is strictly higher than zero, R and R' independently represent a linear or branched, saturated or unsaturated hydrocarbon group optionally substituted by one or more aromatic groups and including from 1 to 30 carbon atoms, or the borate derivatives thereof. It is stated that the hydroxylated esters may be chosen from the monoesters or the diesters obtained from glycerol such as glycerol monooleate, glycerol stearate or isostearate and their borated derivatives. It is also stated that the hydroxylated esters may be chosen from the citrates, tartrates, malates, lactates, mandelates, glycolates, hydroxypropionates, hydroxyglutarates or their borated derivatives. The composition is illustrated only with triethyl citrate and glycerol monostearate.

WO 2010/093519 and US 2010/0210487 relate to fatty sorbitan based friction modifiers which are solid or semi-solid. According to these documents the fatty acid sorbitan ester compositions may comprise tartrates and/or citrates, which may be substituted by alkyl, aryl, acyl alkoxy and/or alkoxy groups. A particularly preferred embodiment is said to utilise an alkyl tartrate in combination with the fatty acid sorbitan ester. Preferred additional additives are said to include $C_{12}$-$C_{14}$ acetal of tartrate, diethyl tartrate, diisopropyl tartrate and mixtures thereof. Laboratory experimental products HXL 7121 and HXL 7353 of Chemtura Corporation are said to be alkyl tartrates of preferred embodiments.

There remains a need for alternative compositions exhibiting anti-wear and/or friction modifier properties for example for use in non-aqueous lubricant compositions and/or for use in internal combustion engine fuel compositions.

Thus, according to the present invention there is provided a non-aqueous lubricant composition comprising a major amount of an oil of lubricating viscosity and a minor amount of at least one long chain fatty acid ester of a hydroxy carboxylic acid in which the long chain fatty acid has at least 4 carbon atoms and the ester is an oil-soluble ester of a mono- or poly-hydroxy carboxylic acid having 1 to 4 groups which are independently carboxylic acid groups or lower hydrocarbyl esters thereof and in which, when the hydroxy carboxylic acid is a mono-hydroxy carboxylic acid, the ester has a long chain fatty acid ester moiety of the hydroxy group of the hydroxy carboxylic acid and, when the hydroxy carboxylic acid is a poly-hydroxy carboxylic acid, the ester has independently long chain fatty acid ester moieties of one or two of the hydroxy groups of the poly-hydroxy carboxylic acid.

Suitably, the lubricant composition may be used to lubricate an internal combustion engine, for example to lubricate the crankcase of an internal combustion engine.

Also according to the present invention, there is provided a method of lubricating an internal combustion engine which method comprises supplying to the engine an oil of lubricating viscosity and at least one long chain fatty acid ester of a hydroxy carboxylic acid in which the long chain fatty acid has at least 4 carbon atoms and the ester is an oil-soluble ester of a mono- or poly-hydroxy carboxylic acid having 1 to 4 groups which are independently carboxylic acid groups or lower hydrocarbyl esters thereof and in which, when the hydroxy carboxylic acid is a mono-hydroxy carboxylic acid, the ester has a long chain fatty acid ester moiety of the hydroxy group of the hydroxy carboxylic acid and, when the hydroxy carboxylic acid is a poly-hydroxy carboxylic acid, the ester has independently long chain fatty acid ester moieties of one or two of the hydroxy groups of the poly-hydroxy carboxylic acid. Suitably, the internal engine is lubricated with a lubricant composition of the present invention, for example as a crankcase lubricant. Additionally or alternatively, the ester may be provided in a liquid fuel composition used to operate the internal combustion engine and during operation of the engine at least a portion of the ester ingresses into a lubricant composition comprising an oil of lubricating viscosity, while the lubricant composition is used to lubricate the engine, for example as a crankcase lubricant.

Also according to the present invention there is provided a method of improving the antiwear and/or friction properties of an oil of lubricating viscosity which method comprises admixing said oil with an effective amount of at least one long chain fatty acid ester of a hydroxy carboxylic acid in which the long chain fatty acid has at least 4 carbon atoms and the ester is an oil-soluble ester of a mono- or poly-hydroxy carboxylic acid having 1 to 4 groups which are independently carboxylic acid groups or lower hydrocarbyl esters thereof and in which, when the hydroxy carboxylic acid is a mono-hydroxy carboxylic acid, the ester has a long chain fatty acid ester moiety of the hydroxy group of the hydroxy carboxylic acid and, when the hydroxy carboxylic acid is a poly-hydroxy carboxylic acid, the ester has independently long chain fatty acid ester moieties of one or two of the hydroxy groups of the poly-hydroxy carboxylic acid.

Also according to the present invention there is provided a method of preparing a non-aqueous lubricant composition which method comprises admixing an oil of lubricating viscosity with an effective amount of at least one long chain fatty acid ester of a hydroxy carboxylic acid in which the long chain fatty acid has at least 4 carbon atoms and the ester is an oil-soluble ester of a mono- or poly-hydroxy carboxylic acid having 1 to 4 groups which are independently carboxylic acid groups or lower hydrocarbyl esters thereof and in which, when the hydroxy carboxylic acid is a mono-hydroxy carboxylic acid, the ester has a long chain fatty acid ester moiety of the hydroxy group of the hydroxy carboxylic acid and, when the hydroxy carboxylic acid is a poly-hydroxy carboxylic acid, the ester has independently long chain fatty acid ester moieties of one or two of the hydroxy groups of the poly-hydroxy carboxylic acid.

Also according to the present invention there is provided an additive concentrate for a non-aqueous lubricant composition comprising (i) at least one long chain fatty acid ester of a hydroxy carboxylic acid in which the long chain fatty acid has at least 4 carbon atoms and the ester is an oil-soluble ester of a mono- or poly-hydroxy carboxylic acid having 1 to 4 groups which are independently carboxylic acid groups or lower hydrocarbyl esters thereof and in which, when the hydroxy carboxylic acid is a mono-hydroxy carboxylic acid, the ester has a long chain fatty acid ester moiety of the hydroxy group of the hydroxy carboxylic acid and, when the hydroxy carboxylic acid is a poly-hydroxy carboxylic acid, the ester has independently long chain fatty acid ester moieties of one or two of the hydroxy groups of the poly-hydroxy carboxylic acid and (ii) at least one other lubricant additive. The additive concentrate may be used in the method of improving the antiwear and/or friction properties of an oil of lubricating viscosity according to the present invention. The additive concentrate may be used in the method of preparing a lubricant composition according to the present invention.

According to a further embodiment of the present invention, there is provided a fuel composition for an internal combustion engine which composition comprises a major amount of a liquid fuel and a minor amount of at least one long chain fatty acid ester of a hydroxy carboxylic acid in which the long chain fatty acid has at least 4 carbon atoms and the ester is an oil-soluble ester of a mono- or poly-hydroxy carboxylic acid having 1 to 4 groups which are independently carboxylic acid groups or lower hydrocarbyl esters thereof and in which, when the hydroxy carboxylic acid is a mono-hydroxy carboxylic acid, the ester has a long chain fatty acid ester moiety of the hydroxy group of the hydroxy carboxylic acid and, when the hydroxy carboxylic acid is a poly-hydroxy carboxylic acid, the ester has independently long chain fatty acid ester moieties of one or two of the hydroxy groups of the poly-hydroxy carboxylic acid.

Also according to the present invention there is provided a method of improving the antiwear and/or friction properties of a liquid fuel, which method comprises admixing said liquid fuel with an effective amount of at least one long chain fatty acid ester of a hydroxy carboxylic acid in which the long chain fatty acid has at least 4 carbon atoms and the ester is an oil-soluble ester of a mono- or poly-hydroxy carboxylic acid having 1 to 4 groups which are independently carboxylic acid groups or lower hydrocarbyl esters thereof and in which, when the hydroxy carboxylic acid is a mono-hydroxy carboxylic acid, the ester has a long chain fatty acid ester moiety of the hydroxy group of the hydroxy carboxylic acid and, when the hydroxy carboxylic acid is a poly-hydroxy carboxylic acid, the ester has independently long chain fatty acid ester moieties of one or two of the hydroxy groups of the poly-hydroxy carboxylic acid.

Also according to the present invention there is provided a method of preparing a fuel composition for an internal combustion engine, which method comprises admixing a liquid fuel with an effective amount of at least one long chain fatty acid ester of a hydroxy carboxylic acid in which the long chain fatty acid has at least 4 carbon atoms and the ester is an oil-soluble ester of a mono- or poly-hydroxy carboxylic acid having 1 to 4 groups which are independently carboxylic acid groups or lower hydrocarbyl esters thereof and in which, when the hydroxy carboxylic acid is a mono-hydroxy carboxylic acid, the ester has a long chain fatty acid ester moiety of the hydroxy group of the hydroxy carboxylic acid and, when the hydroxy carboxylic acid is a poly-hydroxy carboxylic acid, the ester has independently long chain fatty acid ester moieties of one or two of the hydroxy groups of the poly-hydroxy carboxylic acid.

Also according to the present invention there is provided an additive concentrate for a fuel composition for an internal combustion engine, which composition comprises (i) at least one long chain fatty acid ester of a hydroxy carboxylic acid in which the long chain fatty acid has at least 4 carbon atoms and the ester is an oil-soluble ester of a mono- or poly-hydroxy carboxylic acid having 1 to 4 groups which are independently carboxylic acid groups or lower hydrocarbyl esters thereof and in which, when the hydroxy carboxylic acid is a mono-hydroxy carboxylic acid, the ester has a long chain fatty acid ester moiety of the hydroxy group of the hydroxy carboxylic acid and, when the hydroxy carboxylic acid is a poly-hydroxy carboxylic acid, the ester has independently long chain fatty acid ester moieties of one or two of the hydroxy groups of the poly-hydroxy carboxylic acid and (ii) at least one other lubricant additive. The additive concentrate may be used in the method of improving the antiwear and/or friction properties of a liquid fuel according to the present invention. The additive concentrate may be used in the method of preparing a fuel composition according to the present invention.

According to yet a further aspect of the present invention there is provide a method of operating an internal combustion engine which method comprises supplying to the engine a liquid fuel, an oil of lubricating viscosity and at least one long chain fatty acid ester of a hydroxy carboxylic acid in which the long chain fatty acid has at least 4 carbon atoms and the ester is an oil-soluble ester of a mono- or poly-hydroxy carboxylic acid having 1 to 4 groups which are independently carboxylic acid groups or lower hydrocarbyl esters thereof and in which, when the hydroxy carboxylic acid is a mono-hydroxy carboxylic acid, the ester has a long chain fatty acid ester moiety of the hydroxy group of the hydroxy carboxylic acid and, when the hydroxy carboxylic acid is a poly-hydroxy carboxylic acid, the ester has independently long chain fatty acid ester moieties of one or two of the hydroxy groups of the poly-hydroxy carboxylic acid, the long chain fatty acid ester being supplied in admixture with the liquid fuel and/or the oil of lubricating viscosity.

The ester as herein defined has been found to exhibit friction modifier performance. The ester as herein defined has been found to exhibit anti wear performance. In particular, the ester as hereindefined has been found to exhibit both friction modifier performance and anti-wear performance. Therefore, the present invention provides in particular, the use of the ester as hereindefined as a friction modifier. The present invention provides the use of the ester as herein defined as an anti-wear additive. The present invention also provides the use of the ester as herein defined as a friction modifier and an anti wear additive.

The present invention solves the technical problem defined above by the use as an anti-wear additive and/or friction modifier, and in particular as a friction modifier, of at least one long chain fatty acid ester of a hydroxy carboxylic acid in which the long chain fatty acid has at least 4 carbon atoms and the ester is an oil-soluble ester of a mono- or poly-hydroxy carboxylic acid having 1 to 4 groups which are independently carboxylic acid groups or lower hydrocarbyl esters thereof and in which, when the hydroxy carboxylic acid is a mono-hydroxy carboxylic acid, the ester has a long chain fatty acid ester moiety of the hydroxy group of the hydroxy carboxylic acid and, when the hydroxy carboxylic acid is a poly-hydroxy carboxylic acid, the ester has independently long chain fatty acid ester moieties of one or two of the hydroxy groups of the poly-hydroxy carboxylic acid. The use may be in any of the embodiments of the present invention including: the non-aqueous lubricant composition, the method of lubricating an internal combustion engine, the method of improving the antiwear and/or friction properties of an oil of lubricating viscosity, the method of preparing a non-aqueous lubricant composition, the additive concentrate for a non-aqueous lubricant composition, the fuel composition (for example for an internal combustion engine), the method of improving the antiwear and/or friction properties of a liquid fuel, the method of preparing a fuel composition for an internal combustion engine, the additive concentrate for a fuel composition for an internal combustion engine and the method of operating an internal combustion engine.

In a particular aspect, the present invention provides the use as an anti-wear additive and/or friction modifier in a non-aqueous lubricant composition and/or in a fuel composition of at least one long chain fatty acid ester of a hydroxy carboxylic acid in which the long chain fatty acid has at least 4 carbon atoms and the ester is an oil-soluble ester of a mono- or poly-hydroxy carboxylic acid having 1 to 4 groups which are independently carboxylic acid groups or lower hydrocarbyl esters thereof and in which, when the hydroxy carboxylic acid is a mono-hydroxy carboxylic acid, the ester has a long chain fatty acid ester moiety of the hydroxy group of the hydroxy carboxylic acid and, when the hydroxy carboxylic acid is a poly-hydroxy carboxylic acid, the ester has independently long chain fatty acid ester moieties of one or two of the hydroxy groups of the poly-hydroxy carboxylic acid.

Preferably, the oil-soluble ester has at least one long chain fatty acid ester moiety in an alpha position with respect to a carboxylic acid group or lower hydrocarbyl ester thereof.

The oil-soluble ester defined according to the present invention may suitably have from 16 to 80 carbon atoms. The number of carbon atoms in the ester may affect its solubility in oil of lubricating viscosity and/or in liquid fuel.

By oil-soluble is meant that the ester is soluble in an oil of lubricating viscosity and/or a liquid fuel suitably in a friction modifying and/or antiwear improving amount for example in an amount by weight of at least 200 ppm in an oil of lubricating viscosity and/or in an amount by weight of at least 10 ppm in a liquid fuel. The solubility may be determined at ambient temperature, for example at 20° C. The solubility may be determined at atmospheric pressure.

Suitable mono-hydroxy carboxylic acids include:

- glycolic acid (also sometimes called 2-hydroxyethanoic acid; or hydroxyacetic acid);
- citric acid (also sometimes called 3-carboxy-3-hydroxy pentanedioic acid; 2-hydroxypropane-1,2,3-tricarboxylic acid; or 3-hydroxypentanedioic acid-3-carboxylic acid);
- lactic acid (also sometimes called 2-hydroxypropanoic acid;

malic acid (also sometimes called hydroxybutanedioic acid);

monohydroxy trimesic acid; and hydrogenated monohydroxy trimesic acid (sometimes also called 1,3,5 tricarboxy, 2-hydroxy cyclohexane).

A preferred mono-hydroxy carboxylic acid is citric acid.

Suitable poly-hydroxy carboxylic acids include:

tartaric acid (also sometimes called 2,3-dihydroxybutanedioic acid; or 2,3-dihydroxysuccinic acid).

A preferred poly-hydroxy carboxylic acid is tartaric acid.

The long chain fatty acid of the ester has at least 4 carbon atoms. The long chain fatty acid may be saturated, mono-unsaturated or poly-unsaturated. Suitable long chain fatty acids which are saturated carboxylic acids include for example, caproic acid, caprylic acid, capric acid, lauric acid, myristic acid, palmitic acid, stearic acid and arachidic acid. Suitable long chain fatty acids which are mono-unsaturated or polyunsaturated acids include for example, oleic acid, linoleic acid, linolenic acid, myristoleic acid, palmitoleic acid, sapienic acid, erucic acid and brassidic acid. The long chain fatty acid may be branched or linear. The long chain fatty acid may be monocarboxylic or polycarboxylic acid. The long chain fatty acid may have at 4 to 22 carbon atoms, suitably 5 to 22 carbon atoms, more suitably 8 to 22 carbon atoms, yet more suitably 8 to 18 carbon atoms or 14 to 22 carbon atoms, for example 8, 14, 16 or 18 carbon atoms, particularly 8, 14 or 18 carbons atoms, more particularly 14 carbon atoms. Suitable saturated $C_8$ monocarboxylic acids include octanoic acid. Suitable saturated $C_{14}$ monocarboxylic acids include myristic acid. Suitable saturated $C_{16}$ monocarboxylic acids include palmitic acid. Suitable saturated $C_{18}$ monocarboxylic acids include stearic acid. Suitable unsaturated $C_{18}$ monocarboxylic acids include oleic acid and linoleic acid.

Each carboxylic acid group of the mono- or poly-hydroxyl carboxylic acid may be independently derivatisable or derivatized as a lower hydrocarbyl ester. The lower hydrocarbyl esters have hydrocarbyl moieties which independently may have 1 to 6 carbon atoms. The lower hydrocarbyl moieties may be independently straight chain or branched chain alkyl moieties. The lower hydrocarbyl moieties of the lower hydrocarbyl esters may be independently $C_1$ to $C_6$ alkyl moieties, suitably $C_1$ to $C_3$ alkyl moieties, more suitably ethyl moieties.

Suitably, the ester is triethyl citrate oleate (sometimes also called oleyl triethyl citrate). It is believed that triethyl citrate oleate is a novel compound. Suitably, the ester is triethyl citrate butyrate, triethyl citrate octanoate or triethyl citrate myristate, particularly triethyl citrate myristate.

Suitably, the ester is diethyl tartrate dioleate (sometimes also called diethyl dioleate tartrate or diethyl dioleyl tartrate). Suitably, the ester is diethyl tartrate dibutyrate.

The long chain fatty acid esters as defined in accordance with the present invention have an advantage that they do not contain zinc or molybdenum, that is, they are molybdenum-free and zinc-free. They also have an advantage that they are sulphur-free and phosphorus-free. Generally, the esters as herein defined will have low volatility.

The long chain fatty acid esters as defined in accordance with the present invention may be made by methods known in the art, for example by reaction of the corresponding long chain fatty acid with the corresponding mono- or poly-hydroxy carboxylic acid or its corresponding lower hydrocarbyl esters. Another suitable method involves reaction of an acyl halide of the corresponding long chain fatty acid with the corresponding mono- or poly-hydroxy carboxylic acid or its corresponding lower hydrocarbyl esters. For example, triethyl citrate oleate may be made by reaction of triethyl citrate with oleyl chloride, for example in the presence of sodium hydride and tetrahydrofuran solvent. The esters may be made by the Yamaguchi reaction.

The esters may also be made by using enzymes as biological esterification catalysts.

Lubricant Compositions and Additive Concentrates for Lubricant Compositions.

The amount of the at least one long chain fatty acid ester in the lubricant composition may be in the range of 0.02% to 5% by weight, preferably in the range of 0.1 to 2.5% by weight.

The concentration of the at least one long chain fatty acid ester in the additive concentrate may be an amount suitable to provide the required concentration when used in the lubricant composition. The additive concentrate may be used in a lubricant composition in an amount of 0.5 to 20% by weight. Therefore, the amount of the long chain fatty acid ester and any other additives in the lubricant concentrate may be more concentrated than that in the lubricant composition, for example by a factor of from 1:0.005 to 1:0.20.

The lubricant composition comprises a major amount of oil of lubricating viscosity and a minor amount of the at least one long chain fatty acid ester. Major amount means greater than 50% and minor amount means less than 50% by weight.

The lubricant composition and the oil of lubricating viscosity may comprise base oil. Base oil comprises at least one base stock. The oil of lubricating composition may comprise one or more additives other than the at least one long chain fatty acid ester. Suitably, the lubricant composition and/or the oil of lubricating viscosity comprises base oil in an amount of from greater than 50% to about 99.5% by weight, for example from about 85% to about 95% by weight.

The base stocks may be defined as Group I, II, III, IV and V base stocks according to API standard 1509, "ENGINE OIL LICENSING AND CERTIFICATION SYSTEM", April 2007 version $16^{th}$ edition Appendix E, as set out in Table 1.

Group I, Group II and Group III base stocks may be derived from mineral oils Group I base stocks are typically manufactured by known processes comprising solvent extraction and solvent dewaxing, or solvent extraction and catalytic dewaxing. Group II and Group III base stocks are typically manufactured by known processes comprising catalytic hydrogenation and/or catalytic hydrocracking, and catalytic hydroisomerisation. A suitable Group I base stock is AP/E core 150, available from ExxonMobil. Suitable Group II basestocks are EHC 50 and EHC 110, available from ExxonMobil. Suitable group III base stocks include Yubase 4 and Yubase 6 available for example, from SK Lubricants. Suitable Group V base stocks are ester base stocks, for example Priolube 3970, available from Croda International plc. Suitable Group IV base stocks include hydrogenated oligomers of alpha olefins. Suitably, the oligomers may be made by free radical processes, Zeigler catalysis or by cationic Friedel-Crafts catalysis. Polyalpha olefin base stocks may be derived from C8, C10, C12, C14 olefins and mixtures of one or more thereof.

TABLE 1

| Group | Saturated hydrocarbon content (% by weight) ASTM D2007 | | Sulphur content (% by weight) ASTM D2622 or D4294 or D4927 or D3120 | | Viscosity Index ASTM D2270 |
|---|---|---|---|---|---|
| I | <90 | and/or | >0.03 | and | ≥80 and <120 |
| II | ≥90 | and | ≤0.03 | and | ≥80 and <120 |
| III | ≥90 | and | ≤0.03 | and | ≥120 |
| IV | | | polyalpha olefins | | |
| V | | | all base stocks not in Groups I, II, III or IV | | |

The lubricant composition and the oil of lubricating viscosity may comprise one or more base oil and/or base stock which is/are natural oil, mineral oil (sometimes called petroleum-derived oil or petroleum-derived mineral oil), non-mineral oil and mixtures thereof. Natural oils include animal oils, fish oils, and vegetable oils. Mineral oils include paraffinic oils, naphthenic oils and paraffinic-naphthenic oils. Mineral oils may also include oils derived from coal or shale.

Suitable base oils and base stocks oils may be derived from processes such as chemical combination of simpler or smaller molecules into larger or more complex molecules (for example polymerisation, oligomerisation, condensation, alkylation, acylation).

Suitable base stocks and base oils may be derived from gas-to-liquids materials, coal-to-liquids materials, biomass-to-liquids materials and combinations thereof.

Gas-to-liquids (sometimes also referred to as GTL materials) may be obtained by one or more process steps of synthesis, combination, transformation, rearrangement, degradation and combinations of two or more thereof applied to gaseous carbon-containing compounds. GTL derived base stocks and base oils may be obtained from the Fischer-Tropsch synthesis process in which synthesis gas comprising a mixture of hydrogen and carbon monoxide is catalytically converted to hydrocarbons, usually waxy hydrocarbons that are generally converted to lower-boiling materials hydroisomerisation and/or dewaxing (see for example, WO 2008/124191).

Biomass-to-liquids (sometimes also referred to as BTL materials) may be manufactured from compounds of plant origin for example by hydrogenation of carboxylic acids or triglycerides to produce linear paraffins, followed by hydroisomerisation to produced branched paraffins (see for example, WO-2007-068799-A).

Coal-to-liquids materials may be made by gasifying coal to make synthesis gas which is then converted to hydrocarbons.

The base oil and/or oil of lubricating viscosity may have a kinematic viscosity at 100° C. in the range of 2 to 100 cSt, suitably in the range of 3 to 50 cSt and more suitably in the range 3.5 to 25 cSt.

The lubricant composition of the present invention may be a multi-grade lubricating oil composition according to the API classification xW-y where x is 0, 5, 10, 15 or 20 and y is 20, 30, 40, 50 or 60 as defined by SAE J300 2004, for example 5W-20, 5W-30, 0W-20. The lubricant composition may have an HTHS viscosity at 150° C. of at least 2.6 cP, for example as measured according to ASTM D4683, CEC L-36-A-90 or ASTM D5481.

The lubricant composition may have an HTHS viscosity at 150° C. according to ASTM D4683 of from 1 to <2.6 cP, for example 1.8 cP.

The lubricant composition may be prepared by admixing an oil of lubricating viscosity with an effective amount of the at least one long chain fatty acid ester together with optionally at least one other lubricant additive.

The method of preparing a lubricant composition and the method of improving the antiwear and/or friction properties of an oil of lubricating viscosity comprise admixing an oil of lubricating viscosity with an effective amount of the at least one long chain fatty acid ester.

The oil of lubricating viscosity may be admixed with the at least one long chain fatty acid ester in one or more steps by methods known in the art. The at least one long chain fatty acid ester may be admixed as one or more additive concentrates or part additive package concentrates, optionally comprising solvent or diluent. The oil of lubricating viscosity may be prepared by admixing in one or more steps by methods known in the art, one or more base oils and/or base stocks optionally with one or more additives and/or part additive package concentrates. The long chain fatty acid esters, additive concentrates and/or part additive package concentrates may be admixed with oil of lubricating viscosity or components thereof in one or more steps by methods known in the art.

Other Anti-Wear Additives

The lubricant composition and the additive concentrate for a lubricant composition may further comprise at least one anti-wear additive other than the at least one long chain fatty acid ester. Such other anti-wear additives may be ash-producing additives or ashless additives. Examples of such other anti-wear additives include non-phosphorus containing additives for example, sulphurised olefins. Examples of such other anti-wear additives also include phosphorus-containing antiwear additives. Examples of suitable ashless phosphorus-containing anti-wear additives include trilauryl phosphite and triphenylphosphorothionate and those disclosed in paragraph [0036] of US2005/0198894. Examples of suitable ash-forming, phosphorus-containing anti-wear additives include dihydrocarbyl dithiophosphate metal salts. Examples of suitable metals of the dihydrocarbyl dithiophosphate metal salts include alkali and alkaline earth metals, aluminium, lead, tin, molybdenum, manganese, nickel, copper and zinc. Particularly suitable dihydrocarbyl dithiophosphate metal salts are zinc dihydrocarbyl dithiophosphates (ZDDP). The ZDDP's may have hydrocarbyl groups independently having 1 to 18 carbon atoms, suitably 2 to 13 carbon atoms or 3 to 18 carbon atoms, more suitably 2 to 12 carbon atoms or 3 to 13 carbon atoms, for example 3 to 8 carbon atoms. Examples of suitable hydrocarbyl groups include alkyl, cycloalkyl and alkaryl groups which may contain ether or ester linkages and also which may contain substituent groups for example, halogen or nitro groups. The hydrocarbyl groups may be alkyl groups which are linear and/or branched and suitably may have from 3 to 8 carbon atoms. Particularly suitable ZDDP's have hydrocarbyl groups which are a mixture of secondary alky groups and primary alkyl groups for example, 90 mol. % secondary alkyl groups and 10 mol. % primary alkyl groups.

The at least one long chain fatty acid of the present invention may reduce the amount of phosphorus- and/or zinc-containing anti-wear additive which might be required to achieve a desired amount of anti-wear properties for the lubricant composition.

Phosphorus-containing anti-wear additives may be present in the lubricating oil composition at a concentration of 10 to 6000 ppm by weight of phosphorus, suitably 10 to 1000 ppm by weight of phosphorus, for example 200 to 1400 ppm by weight of phosphorus, or 200 to 800 ppm by weight of phosphorus or 200 to 600 ppm by weight of phosphorus.

It has been found that the presence in the lubricant composition of the at least one long chain fatty acid ester as defined in accordance with the present invention may assist in the performance of anti-wear additives, for example, zinc dihydrocarbyl dithiophosphate additives. This may have an advantage of reducing the amount of metals, for example zinc, or other ash-forming elements present in the lubricant composition.

This may also have an advantage of reducing the amount of phosphorus-containing anti-wear additives in the lubricant composition which in turn may reduce the amount of phosphorus in the exhaust emissions when the lubricant is used to lubricate an internal combustion engine. The reduction in the amount of phosphorus in the exhaust emissions may have benefits for any exhaust after treatment system.

This may also have an advantage of reducing the amount of sulphur-containing anti-wear additives in the lubricant composition which in turn may reduce the amount of sulphur in the exhaust emissions when the lubricant is used to lubricate an internal combustion engine. The reduction in the amount of sulphur in the exhaust emissions may have benefits for any exhaust after treatment system.

Other Friction Modifiers.

The lubricant composition and the additive concentrate for a lubricant composition may further comprise at least one friction modifier other than the at least one long chain fatty acid ester. Such other friction modifiers may be ash-producing additives or ashless additives. Examples of such other friction modifiers include fatty acid derivatives including for example, other fatty acid esters, amides, amines, and ethoxylated amines. Examples of suitable ester friction modifiers include esters of glycerol for example, mono-, di-, and tri-oleates, mono-palmitates and mono-myristates. A particularly suitable fatty acid ester friction modifier is glycerol monooleate. Examples of such other friction modifiers may also include molybdenum compounds for example, organo molybdenum compounds, molybdenum dialkyldithiocarbamates, molybdenum dialkylthiophosphates, molybdenum disulphide, tri-molybdenum cluster dialkyldithiocarbamates, non-sulphur molybdenum compounds and the like. Suitable molybdenum-containing compounds are described for example, in EP-1533362-A1 for example in paragraphs [0101] to [0117].

Friction modifiers other than the long chain fatty acid esters of the present invention may also include a combination of an alkoxylated hydrocarbyl amine and a polyol partial ester of a saturated or unsaturated fatty acid or a mixture of such esters, for example as described in WO 93/21288.

The long chain fatty acid esters of the present invention may be used as an alternative to other friction modifiers or may reduce the amount of such other friction modifiers which might be required to achieve a desired friction property for the lubricant composition. This may have an advantage of reducing the amount of metals, for example molybdenum, present in the lubricant composition.

Friction modifiers other than the long chain fatty acid esters of the present invention which are other fatty acid derivative friction modifiers may be present in the lubricating oil composition at a concentration of 0.01 to 5% by weight actives, more suitably in the range of 0.01 to 1.5% by weight actives.

Molybdenum containing friction modifiers may be present in the lubricating oil composition at a concentration of 10 to 1000 ppm by weight molybdenum, more suitably in the range of 400 to 600 ppm by weight.

Other Additives.

The lubricant composition and the additive concentrate for a lubricant composition may also comprise other additives. Examples of such other additives include dispersants (metallic and non-metallic), dispersant viscosity modifiers, detergents (metallic and non-metallic), viscosity index improvers, viscosity modifiers, pour point depressants, rust inhibitors, corrosion inhibitors, antioxidants (sometimes also called oxidation inhibitors), anti-foams (sometimes also called anti-foaming agents), seal swell agents (sometimes also called seal compatibility agents), extreme pressure additives (metallic, non-metallic, phosphorus containing, non-phosphorus containing, sulphur containing and non-sulphur containing), surfactants, demulsifiers, anti-seizure agents, wax modifiers, lubricity agents, anti-staining agents, chromophoric agents and metal deactivators.

Dispersants

Dispersants (also called dispersant additives) help hold solid and liquid contaminants for example resulting from oxidation of the lubricant composition during use, in suspension and thus reduce sludge flocculation, precipitation and/or deposition for example on lubricated surfaces. They generally comprise long-chain hydrocarbons, to promote oil-solubility, and a polar head capable of associating with material to be dispersed. Examples of suitable dispersants include oil soluble polymeric hydrocarbyl backbones each having one or more functional groups which are capable of associating with particles to be dispersed. The functional groups may be amine, alcohol, amine-alcohol, amide or ester groups. The functional groups may be attached to the hydrocarbyl backbone through bridging groups. More than one dispersant may be present in the additive concentrate and/or lubricant composition.

Examples of suitable ashless dispersants include oil soluble salts, esters, amino-esters, amides, imides and oxazolines of long chain hydrocarbon-substituted mono- and polycarboxylic acids or anhydrides thereof; thiocarboxylate derivatives of long chain hydrocarbons; long chain aliphatic hydrocarbons having polyamine moieties attached directly thereto; Mannich condensation products formed by condensing a long chain substituted phenol with formaldehyde and polyalkylene polyamine; Koch reaction products and the like. Examples of suitable dispersants include derivatives of long chain hydrocarbyl-substituted carboxylic acids, for example in which the hydrocarbyl group has a number average molecular weight of up to 20000, for example 300 to 20000, 500 to 10000, 700 to 5000 or less than 15000. Examples of suitable dispersants include hydrocarbyl-substituted succinic acid compounds, for example succinimide, succinate esters or succinate ester amides and in particular, polyisobutenyl succinimide dispersants. The dispersants may be borated or non-borated. A suitable dispersant is ADX 222.

Dispersant Viscosity Modifiers.

Additionally or alternatively, dispersancy may be provided by polymeric compounds capable of providing viscosity index improving properties and dispersancy. Such compounds are generally known as dispersant viscosity improver additives or multifunctional viscosity improvers. Examples of suitable dispersant viscosity modifiers may be prepared by chemically attaching functional moieties (for example amines, alcohols and amides) to polymers which tend to have number average molecular weights of at least 15000, for example in the range 20000 to 600000 (for example as determined by gel permeation chromatography or light scattering methods). Examples of suitable dispersant viscosity modifiers and methods of making them are described in WO 99/21902, WO2003/099890 and WO2006/099250. More than one dispersant viscosity modifier may be present in the additive concentrate and/or lubricant composition.

Detergents

Detergents (also called detergent additives) may help reduce high temperature deposit formation for example on pistons in internal combustion engines, including for example high-temperature varnish and lacquer deposits, by helping to keep finely divided solids in suspension in the lubricant composition. Detergents may also have acid-neutralising properties. Ashless (that is non-metal containing detergents) may be present. Metal-containing detergent comprises at least one metal salt of at least one organic acid, which is called soap or surfactant. Detergents may be overbased in which the detergent comprises an excess of metal in relation to the stoichiometric amount required to neutralise the organic acid. The excess metal is usually in the form of a colloidal dispersion of metal carbonate and/or hydroxide. Examples of suitable metals include Group I and Group 2 metals, more suitably calcium, magnesium and combinations thereof, especially calcium. More than one metal may be present.

Examples of suitable organic acids include sulphonic acids, phenols (sulphurised or preferably sulphurised and including for example, phenols with more than one hydroxyl group, phenols with fused aromatic rings, phenols which have been modified for example alkylene bridged phenols, and Mannich base-condensed phenols and saligenin-type phenols, produced for example by reaction of phenol and an aldehyde under basic conditions) and sulphurised derivatives thereof, and carboxylic acids including for example, aromatic carboxylic acids (for example hydrocarbyl-substituted salicylic acids and sulphurised derivatives thereof, for example hydrocarbyl substituted salicylic acid and derivatives thereof). More than one type of organic acid may be present.

Additionally or alternatively, non-metallic detergents may be present. Suitable non-metallic detergents are described for example in U.S. Pat. No. 7,622,431.

More than one detergent may be present in the lubricant composition and/or additive concentrate.

Viscosity Index Improvers/Viscosity Modifiers

Viscosity index improvers (also called viscosity modifiers, viscosity improvers or VI improvers) impart high and low temperature operability to a lubricant composition and facilitate it remaining shear stable at elevated temperatures whilst also exhibiting acceptable viscosity and fluidity at low temperatures.

Examples of suitable viscosity modifiers include high molecular weight hydrocarbon polymers (for example polyisobutylene, copolymers of ethylene and propylene and higher alpha-olefins); polyesters (for example polymethacrylates); hydrogenated poly(styrene-co-butadiene or isoprene) polymers and modifications (for example star polymers); and esterified poly(styrene-co-maleic anhydride) polymers. Oil-soluble viscosity modifying polymers generally have number average molecular weights of at least 15000 to 1000000, preferably 20000 to 600000 as determined by gel permeation chromatography or light scattering methods.

Viscosity modifiers may have additional functions as multifunction viscosity modifiers. More than one viscosity index improver may be present.

Pour Point Depressants

Pour point depressants (also called lube oil improvers or lube oil flow improvers), lower the minimum temperature at which the lubricant will flow and can be poured. Examples of suitable pour point depressants include $C_8$ to $C_{18}$ dialkyl fumarate/vinyl acetate copolymers, methacrylates, polyacrylates, polyarylamides, polymethacrylates, polyalkyl methacrylates, vinyl fumarates, styrene esters, condensation products of haloparaffin waxes and aromatic compounds, vinyl carboxylate polymers, terpolymers of dialkyfumarates, vinyl esters of fatty acids and allyl vinyl ethers, wax naphthalene and the like.

More than one pour point depressant may be present.

Rust Inhibitors

Rust inhibitors generally protect lubricated metal surfaces against chemical attack by water or other contaminants. Examples of suitable rust inhibitors include non-ionic polyoxyalkylene polyols and esters thereof, polyoxyalkylene phenols, polyoxyalkylene polyols, anionic alky sulphonic acids, zinc dithiophosphates, metal phenolates, basic metal sulphonates, fatty acids and amines.

More than one rust inhibitor may be present.

Corrosion Inhibitors

Corrosion inhibitors (also called anti-corrosive agents) reduce the degradation of metallic parts contacted with the lubricant composition. Examples of corrosion inhibitors include phosphosulphurised hydrocarbons and the products obtained by the reaction of phosphosulphurised hydrocarbon with an alkaline earth metal oxide or hydroxide, non-ionic polyoxyalkylene polyols and esters thereof, polyoxyalkylene phenols, thiadiazoles, triazoles and anionic alkyl sulphonic acids. Examples of suitable epoxidised ester corrosion inhibitors are described in US2006/0090393.

More than one corrosion inhibitor may be present.

Antioxidants

Antioxidants (sometimes also called oxidation inhibitors) reduce the tendency of oils to deteriorate in use. Evidence of such deterioration might include for example the production of varnish-like deposits on metal surfaces, the formation of sludge and viscosity increase. ZDDP's exhibit some antioxidant properties.

Examples of suitable antioxidants other than ZDDP's include alkylated diphenylamines, N-alkylated phenylenediamines, phenyl-α-naphthylamine, alkylated phenyl-α-naphthylamines, dimethylquinolines, trimethyldihydroquinolines and oligomeric compositions derived therefrom, hindered phenolics (including ashless (metal-free) phenolic compounds and neutral and basic metal salts of certain phenolic compounds), aromatic amines (including alkylated and non-alkylated aromatic amines), sulphurised alkyl phenols and alkali and alkaline earth metal salts thereof, alkylated hydroquinones, hydroxylated thiodiphenyl ethers, alkylidenebisphenols, thiopropionates, metallic dithiocarbamates, 1,3,4-dimercaptothiadiazole and derivatives, oil soluble copper compounds (for example, copper dihydrocarbyl thio- or thio-phosphate, copper salts of a synthetic or natural carboxylic acids, for example a $C_8$ to $C_{18}$ fatty acid, an unsaturated acid or a branched carboxylic acid, for example basic, neutral or acidic $Cu^I$ and/or $Cu^{II}$ salts derived from alkenyl succinic acids or anhydrides), alkaline earth metal salts of alkylphenolthioesters, suitably having $C_5$ to $C_{12}$ alkyl side chains, calcium nonylphenol sulphide, barium t-octylphenyl sulphide, dioctylphenylamine, phosphosulphised or sulphurised hydrocarbons, oil soluble phenates, oil soluble sulphurised phenates, calcium dodecylphenol sulphide, phosphosulphurised hydrocarbons, sulphurised hydrocarbons, phosphorus esters, low sulphur peroxide decomposers and the like.

More than one anti oxidant may be present. More than one type of anti oxidant may be present.

Antifoams

Anti-foams (sometimes also called anti-foaming agents) retard the formation of stable foams. Examples of suitable anti-foam agents include silicones, organic polymers, siloxanes (including poly siloxanes and (poly) dimethyl siloxanes, phenyl methyl siloxanes), acrylates and the like.

More than one anti-foam may be present.

Seal Swell Agents

Seal swell agents (sometimes also called seal compatibility agents or elastomer compatibility aids) help to swell elastomeric seals for example by causing a reaction in the fluid or a physical change in the elastomer. Examples of suitable seal swell agents include long chain organic acids, organic phosphates, aromatic esters, aromatic hydrocarbons, esters (for example butylbenzyl phthalate) and polybutenyl succinic anhydride.

More than one seal swell agent may be present.

Other Additives

Examples of other additives which may be present in the lubricant composition and/or additive concentrate include extreme pressure additives (including metallic, non-metallic, phosphorus containing, non-phosphorus containing, sulphur containing and non-sulphur containing extreme pressure additives), surfactants, demulsifiers, anti-seizure agents, wax modifiers, lubricity agents, anti-staining agents, chromophoric agents and metal deactivators.

Some additives may exhibit more than one function.

The amount of demulsifier, if present, might be higher than in conventional lubricants to off-set any emulsifying effect of the at least one long chain fatty acid ester.

Solvent

The additive concentrate for a lubricant composition may comprise solvent. Examples of suitable solvents include highly aromatic, low viscosity base stocks, for example 100N, 60 N and 100SP base stocks.

The representative suitable and more suitable independent amounts of additives (if present) in the lubricant composition are given in Table 2. The concentrations expressed in Table 2 are by weight of active additive compounds that is, independent of any solvent or diluent.

More than one of each type of additive may be present. Within each type of additive, more than one class of that type of additive may be present. More than one additive of each class of additive may be present. Additives may suitably be supplied by manufacturers and suppliers in solvent or diluents.

TABLE 2

| | Lubricant Composition | |
|---|---|---|
| ADDITIVE TYPE | Suitable amount (actives), if present (by weight) | More Suitable amount (actives), if present (by weight) |
| Long chain fatty acid ester of a hydroxy carboxylic acid in which the long chain fatty acid has at least 4 carbon atoms and the ester is an oil-soluble ester of a mono- or poly-hydroxy carboxylic acid having 1 to 4 groups which are independently carboxylic acid groups or lower hydrocarbyl esters thereof and in which, when the hydroxy carboxylic acid is a mono-hydroxy carboxylic acid, the ester has a long chain fatty acid ester moiety of the hydroxy group of the hydroxy carboxylic acid and, when the hydroxy carboxylic acid is a poly-hydroxy carboxylic acid, the ester has independently long chain fatty acid ester moieties of one or two of the hydroxy groups of the poly-hydroxy carboxylic acid | 0.02 to 5% | 0.1 to 2.5% |
| Phosphorus-containing anti-wear additives | corresponding to 10 to 6000 ppm P | corresponding to 10 to 1000 ppm P |
| Molybdenum-containing anti-wear additives | corresponding to 10 to 1000 ppm Mo | corresponding to 40 to 600 ppm Mo |
| Boron-containing anti-wear additives | corresponding to 10 to 250 ppm B | corresponding to 50 to 100 ppm B |
| Friction modifiers other than the long chain fatty acid esters | 0.01 to 5% | 0.01 to 1.5% |
| Molybdenum-containing friction modifiers | corresponding to 10 to 1000 ppm Mo | corresponding to 400 to 600 ppm Mo |
| Dispersants | 0.1 to 20% | 0.1 to 8% |
| Detergents | 0.01 to 6% | 0.01 to 4% |
| Viscosity index improvers | 0.01 to 20% | 0.01 to 15% |
| Pour point depressants | 0.01 to 5% | 0.01 to 1.5% |
| Corrosion and/or rust inhibitors | 0.01 to 5% | 0.01 to 1.5% |
| Anti-oxidants | 0.1 to 10% | 0.5 to 5% |
| Antifoams containing silicon | corresponding to 1 to 20 ppm Si | corresponding to 1 to 10 ppm Si |

Lubricant Applications.

The one long chain fatty acid esters as defined in accordance with the present invention may be used as an anti-wear additive and/or friction modifier in a non-aqueous lubricant composition and/or in a fuel composition.

The long chain fatty acid esters as defined in accordance with the present invention may be used as an anti-wear additive and/or friction modifier in a lubricant composition which is a functional fluid, for example a metalworking fluid which may be used to lubricate metals during machining, rolling and the like. Suitably, the lubricant composition is a lubricant composition according to the present invention.

The long chain fatty acid esters as defined in accordance with the present invention may be used as an anti-wear additive and/or friction modifier in a lubricant composition which is a power transmission fluid for example useful as an automatic transmission fluid, a fluid in a clutch (for example a dual clutch), a gear lubricant, or in other automotive applications and the like. Suitably, the lubricant composition is a lubricant composition according to the present invention. The additive and lubricant composition may suitably be used in aviation lubricant applications.

The long chain fatty acid esters as defined in accordance with the present invention may be used as an anti-wear additive and/or friction modifier in a lubricant composition suitable for use in turbine lubrication.

The long chain fatty acid esters as defined in accordance with the present invention may be used as an anti-wear additive and/or friction modifier in a non-aqueous lubricant composition and/or in a fuel composition used to lubricate a solid surface, including for example metallic surfaces and non-metallic surfaces. Suitable metallic surfaces include surfaces of ferrous based materials, for example cast iron and steels; surfaces of aluminium-based solids, for example aluminium-silicon alloys; surfaces of metal matrix compositions; surfaces of copper and copper alloys; surfaces of lead and lead alloys; surfaces of zinc and zinc alloys; and surfaces of chromium-plated materials. Suitable non-metallic surfaces include surfaces of ceramic materials; surfaces of polymer materials; surfaces of carbon-based materials; and surfaces of glass. Other surfaces which may be lubricated include surfaces of coated materials for example surfaces of hybrid materials for example metallic materials coated with non-metallic materials and nonmetallic materials coated with metallic materials; surfaces of diamond-like carbon coated materials and SUMEBore™ materials for example as described in Sultzer technical review April 2009 pages 11-13.

The long chain fatty acid esters as defined in accordance with the present invention may be used in a non-aqueous lubricant composition and/or in a fuel composition to lubricate a surface at any typical temperature which might be encountered in a lubricating environment, for example at a temperature such as may be encountered in an internal combustion engine, for example a temperature in the range of ambient to 250° C., e.g. 90 to 120° C. Typically ambient temperature may be 20° C., but may be less than 20° C., for example 0° C.

Internal Combustion Engine Lubrication.

The long chain fatty acid esters as defined in accordance with the present invention may be used as an anti-wear additive and/or friction modifier in a lubricant composition which may be used to lubricate an internal combustion engine, for example as a crankcase lubricant. The engine may be a spark-ignition, internal combustion engine, or a compression-ignition, internal combustion engine. The internal combustion engine may be a spark-ignition internal combustion engine used in automotive or aviation applications. The internal combustion engine may be a two-stroke compression-ignition engine and the at least one long chain fatty acid ester may be used as an anti-wear additive and/or friction modifier in a system oil lubricant composition and/or a cylinder oil lubricant composition used to lubricate the engine. The two-stroke compression-ignition engine may be used in marine applications.

In the method of lubricating an internal combustion engine according to the present invention, the at least one long chain fatty acid ester may be present in a lubricant composition used to lubricate the engine, for example to lubricate the crankcase of the engine. Suitably, such a lubricant composition is a lubricant composition according to the present invention.

The at least one long chain fatty acid ester may be added to the lubricant composition used to the lubricate the engine by slow release of the additive into the lubricant—for example by contacting the lubricant composition with a gel comprising the additive, for example as described in U.S. Pat. No. 6,843,916 and international PCT patent application publication WO 2008/008864 and/or by controlled release of the additive, for example when the back pressure of lubricant passing through a filter exceeds a define back pressure, for example as described in international PCT patent application publication WO2007/148047.

Additionally, or alternatively the at least one long chain fatty acid ester may be present in the fuel for an internal combustion engine. In use, the at least one long chain fatty acid ester may pass with or without fuel into a lubricant composition used to lubricate the engine, for example as a crankcase lubricant and thereby provide antiwear and/or friction modifier benefits to the engine.

Thus according to a further aspect of the present invention, there is provided a fuel composition for an internal combustion engine which composition comprises a major amount of a liquid fuel and a minor amount of at least one long chain fatty acid ester of a hydroxy carboxylic acid which is an oil-soluble ester of a mono- or poly-hydroxy carboxylic acid having 1 to 4 groups which are independently carboxylic acid groups or lower hydrocarbyl esters thereof and in which, when the hydroxy carboxylic acid is a mono-hydroxy carboxylic acid, the ester has a long chain fatty acid ester moiety of the hydroxy group of the hydroxy carboxylic acid and, when the hydroxy carboxylic acid is a poly-hydroxy carboxylic acid, the ester has independently two long chain fatty acid ester moieties of two hydroxy groups of the poly-hydroxy carboxylic acid.

The engine may be a spark-ignition, internal combustion engine, or a compression-ignition, internal combustion engine. The engine may be a homogeneous charge compression ignition internal combustion engine. The internal combustion engine may be a spark-ignition internal combustion engine used in automotive or aviation applications. The internal combustion engine may be a two-stroke compression-ignition engine. The two-stroke compression-ignition engine may be used in marine applications.

The at least one long chain fatty acid ester may be present in the fuel at a concentration of up to 500 ppm by weight, for example 20 to 200 ppm by weight or 50 to 100 ppm by weight.

Typically, the rate of ingress of fuel into crankcase lubricant is higher for spark-ignition internal combustion engines than for compression-ignition engines. However, the rate at which fuel ingresses into the crankcase lubricant for compression-ignition engines may depend and may increase depending upon the use of post-injection strategies for operation of the engine.

The at least one long chain fatty acid ester defined in accordance with the present invention, present in the fuel composition may reduce wear in the fuel system of the engine, for example the fuel pump.

Fuels

Suitable liquid fuels, particularly for internal combustion engines include hydrocarbon fuels, oxygenate fuels and combinations thereof. Hydrocarbon fuels may be derived from mineral sources and/or from renewable sources such as biomass (e.g. biomass-to-liquid sources) and/or from gas-to-liquid sources and/or from coal-to-liquid sources. Suitable sources of biomass include sugar (e.g. sugar to diesel fuel) and algae. Suitable oxygenate fuels include alcohols for example, straight and/or branched chain alkyl alcohols having from 1 to 6 carbon atoms, esters for example, fatty acid alkyl esters and ethers, for example methyl tert butyl ether. Suitable fuels may also include LPG-diesel fuels (LPG being liquefied petroleum gas). The fuel composition may be an emulsion. However, suitably, the fuel composition is not an emulsion.

Suitable fatty acid alkyl esters include methyl, ethyl, propyl, butyl and hexyl esters. Usually, the fatty acid alkyl ester is a fatty acid methyl ester. The fatty acid alkyl ester may have 8 to 25 carbon atoms, suitably, 12 to 25 carbon atoms, for example 16 to 18 carbon atoms. The fatty acid may be saturated or unsaturated. Usually, the fatty acid alkyl ester is acyclic. Fatty acid alkyl esters may be prepared by esterification of one or more fatty acids and/or by transesterification of one or more triglycerides of fatty acids. The triglycerides may be obtained from vegetable oils, for example, castor oil, soyabean oil, cottonseed oil, sunflower oil, rapeseed oil (which is sometimes called canola oil), Jatropha oil or palm oil, or obtained from tallow (for example sheep and/or beef tallow), fish oil or used cooking oil. Suitable fatty acid alkyl esters include rapeseed oil methyl ester (RME), soya methyl ester or combinations thereof.

The fuel composition according to the present invention may be prepared by admixing in one or more steps a hydrocarbon fuel, an oxygenate fuel or a combination thereof with an effective amount of at least one long chain fatty acid ester defined in accordance with the present invention and optionally at least one other fuel additive.

The method of preparing a fuel composition and the method of improving the antiwear and/or friction properties of a liquid fuel may comprise admixing in one or more steps said liquid fuel (which may be for example a hydrocarbon fuel, an oxygenate fuel or a combination thereof) with an effective amount of at least one long chain fatty acid ester of a hydroxy carboxylic acid which is an oil-soluble ester of a mono- or poly-hydroxy carboxylic acid having 1 to 4 groups which are independently carboxylic acid groups or lower hydrocarbyl esters thereof and in which, when the hydroxy carboxylic acid is a mono-hydroxy carboxylic acid, the ester has a long chain fatty acid ester moiety of the hydroxy group of the hydroxy carboxylic acid and, when the hydroxy carboxylic acid is a poly-hydroxy carboxylic acid, the ester has independently two long chain fatty acid ester moieties of two hydroxy groups of the poly-hydroxy carboxylic acid and optionally at least one other fuel additive.

The fuel may be admixed with at least one additive in one or more steps by methods known in the art. The additives may be admixed as one or more additive concentrates or part additive package concentrates, optionally comprising solvent or diluent. The hydrocarbon fuel, oxygenate fuel or combination thereof may be prepared by admixing in one or more steps by methods known in the art, one or more base fuels and components therefor, optionally with one or more additives and/or part additive package concentrates. The additives, additive concentrates and/or part additive package concentrates may be admixed with the fuel or components therefor in one or more steps by methods known in the art.

Fuels and Concentrates for Compression-Ignition Engines.

The fuel composition of the present invention may be suitable for use in an internal combustion engine which is a compression-ignition internal combustion engine, suitably a direct injection diesel engine, for example of the rotary pump, in-line pump, unit pump, electronic unit injector or common rail type, or in an indirect injection diesel engine. The fuel composition may be suitable for use in heavy and/or light duty diesel engines.

The fuel composition for compression-ignition internal combustion engines may have a sulphur content of up to 500 ppm by weight, for example, up to 15 ppm by weight or up to 10 ppm by weight. The fuel composition for compression-ignition internal combustion engines may meet the requirements of the EN590 standard, for example as set out in BS EN 590:2009.

Suitable oxygenate components in the fuel composition for compression-ignition internal combustion engines include fatty acid alkyl esters, for example fatty acid methyl esters. The fuel may comprise one or more fatty acid methyl esters complying with EN 14214 at a concentration of up to 7% by volume. Oxidation stability enhancers may be present in the fuel composition comprising one or more fatty acid alkyl or methyl esters, for example at a concentration providing an action similar to that obtained with 1000 mg/kg of 3,5-di-tert-butyl-4-hydroxy-toluol (also called butylated hydroxyl-toluene or BHT). Dyes and/or markers may be present in the fuel composition for compression-ignition internal combustion engines.

The fuel composition for compression-ignition internal combustion engines may have one or more of the following, for example, as defined according to BS EN 590:2009: —a minimum cetane number of 51.0, a minimum cetane index of 46.0, a density at 15° C. of 820.0 to 845.0 kg/m$^3$, a maximum polycyclic aromatic content of 8.0% by weight, a flash point above 55° C., a maximum carbon residue (on 10% distillation) of 0.30% by weight, a maximum water content of 200 mg/kg, a maximum contamination of 24 mg/kg, a class1 copper strip corrosion (3 h at 50° C.), a minimum oxidation stability limit of 20 h according to EN 15751 and a maximum oxidation stability limit of 25 g/m$^3$ according to EN ISO 12205, a maximum limit for lubricity corrected wear scar diameter at 60° C. of 460 μm, a minimum viscosity at 40° C. of 2.00 mm$^2$/s and a maximum viscosity at 40° C. of 4.50 mm$^2$/s, <65% by volume distillation recovery at 250° C., a minimum distillation recovery at 350° C. of 85% by volume and a maximum of 95% by volume recovery at 360° C.

The fuel composition and the additive concentrate for a fuel composition suitable for use in a compression-ignition internal combustion engine may further comprise at least one friction modifier other than the long chain fatty acid ester defined in accordance with the present invention. Such other friction modifiers include compounds described herein as friction modifiers for lubricant compositions and additive concentrates for lubricant compositions.

The fuel composition and the additive concentrate for a fuel composition suitable for use with a compression-ignition internal combustion engine may further comprise at least one lubricity additive. Suitable lubricity additives include tall oil fatty acids, mono- and di-basic acids and esters.

The fuel composition and the additive concentrate for a fuel composition suitable for use in a compression-ignition internal combustion engine may further comprise independently one or more cetane improver, one or more detergent, one or more anti-oxidant, one or more anti-foam, one or more demulsifier, one or more cold flow improver, one or more pour point depressant, one or more biocide, one or more odorant, one or more colorant (sometimes called dyes), one or more marker, one or more spark aiders and/or combinations of one or more thereof. Other suitable additives which may be present include thermal stabilizers, metal deactivators, corrosion inhibitors, antistatic additives, drag reducing agents, emulsifiers, dehazers, anti-icing additives, antiknock additives, anti-valve-seat recession additives, surfactants and combustion improvers, for example as described in EP-2107102-A.

The additive concentrate for a fuel composition for a compression-ignition internal combustion engine may comprise solvent. Suitable solvents include carrier oils (for example mineral oils), polyethers (which may be capped or uncapped), non-polar solvents (for example toluene, xylene, white spirits and those sold by Shell companies under the trade mark "SHELLSOL"), and polar solvents (for example esters and alcohols e.g. hexanol, 2-ethylhexanol, decanol, isotridecanol and alcohol mixtures, for example those sold by Shell companies under the trade mark "LINEVOL", e.g. LINEVOL 79 alcohol which is a mixture of $C_{7-9}$ primary alcohols, or a $C_{12-14}$ alcohol mixture which is commercially available.

Suitable cetane improvers include 2-ethyl hexyl nitrate, cyclohexyl nitrate and di-tert-butyl peroxide. Suitable anti-foams include siloxanes. Suitable detergents include polyolefin substituted succinimides and succinamides of polyamines, for example polyisobutylene succinimides, polyisobutylene amine succinimides, aliphatic amines, Mannich bases and amines and polyolefin (e.g. polyisobutylene) maleic anhydride. Suitable antioxidants include phenolic antioxidants (for example 2,6-di-tert-butylphenol) and aminic antioxidants (for example N,N'-di-sec-butyl-p-phenylenediamine) Suitable anti-foaming agents include polyether-modified polysiloxanes.

The representative suitable and more suitable independent amounts of additives (if present) in the fuel composition suitable for a compression-ignition engine are given in Table 3. The concentrations expressed in Table 3 are by weight of active additive compounds that is, independent of any solvent or diluent.

The additives in the fuel composition suitable for use in compression-ignition internal combustion engines are suitably present in a total amount in the range of 100 to 1500 ppm by weight. Therefore, the concentrations of each additive in an additive concentrate will be correspondingly higher than in the fuel composition, for example by a ratio of 1:0.0002 to 0.0015. The additives may be used as part-packs, for example part of the additives (sometimes called refinery additives) being added at the refinery during manufacture of a fungible fuel and part of the additives (sometimes called terminal or marketing additives) being added at a terminal or distribution point. The at least long chain fatty acid ester defined in accordance with the present invention may suitably be added or used as a refinery or marketing additive, preferably as a marketing additive for example at a terminal or distribution point.

TABLE 3

| | Fuel composition for compression-ignition internal combustion engine | |
|---|---|---|
| Additive type | Suitable amount (actives), if present (ppm by weight) | More suitable amount (actives), if present (ppm by weight) |
| Long chain fatty acid ester of a hydroxy carboxylic acid in which the long chain fatty acid has at least 4 carbon atoms and the ester is an oil-soluble ester of a mono- or poly- hydroxy carboxylic acid having 1 to 4 groups which are independently carboxylic acid groups or lower hydrocarbyl esters thereof and in which, when the hydroxy carboxylic acid is a mono-hydroxy carboxylic acid, the ester has a long chain fatty acid ester moiety of the hydroxy group of the hydroxy carboxylic acid and, when the hydroxy carboxylic acid is a poly-hydroxy carboxylic acid, the ester has independently long chain fatty acid ester moieties of one or two of the hydroxy groups of the poly-hydroxy carboxylic acid | 20 to 500 | 20 to 200 |
| Lubricity additives | 1 to 200 | 50 to 200 |
| Cetane improvers | 50 to 2000 | 100 to 1200 |
| Detergents | 20 to 300 | 50 to 200 |
| Anti-oxidants | 1 to 100 | 2 to 50 |
| Anti foams | 1 to 50 | 5 to 20 |
| Demulsifiers | 1 to 50 | 5 to 25 |
| Cold flow improvers | 10 to 500 | 50 to 100 |

Fuels and Concentrates for Spark-Ignition Engines.

The fuel composition of the present invention may be suitable for use in an internal combustion engine which is a spark-ignition internal combustion engine.

The fuel composition for spark-ignition internal combustion engines may have a sulphur content of up to 50.0 ppm by weight, for example up to 10.0 ppm by weight.

The fuel composition for spark-ignition internal combustion engines may be leaded or unleaded.

The fuel composition for spark-ignition internal combustion engines may meet the requirements of EN 228, for example as set out in BS EN 228:2008. The fuel composition for spark-ignition internal combustion engines may meet the requirements of ASTM D 4814-09b.

The fuel composition for spark-ignition internal combustion engines may have one or more of the following, for example, as defined according to BS EN 228:2008: —a minimum research octane number of 95.0, a minimum motor octane number of 85.0 a maximum lead content of 5.0 mg/l, a density of 720.0 to 775.0 kg/m$^3$, an oxidation stability of at least 360 minutes, a maximum existent gum content (solvent washed) of 5 mg/100 ml, a class 1 copper strip corrosion (3 h at 50° C.), clear and bright appearance, a maximum olefin content of 18.0% by weight, a maximum aromatics content of 35.0% by weight, and a maximum benzene content of 1.00% by volume.

Suitable oxygenate components in the fuel composition for spark-ignition internal combustion engines include straight and/or branched chain alkyl alcohols having from 1 to 6 carbon atoms, for example methanol, ethanol, n-propanol, n-butanol, isobutanol, tert-butanol. Suitable oxygenate components in the fuel composition for spark-ignition internal combustion engines include ethers, for example having 5 or more carbon atoms. The fuel composition may have a maximum oxygen content of 2.7% by mass. The fuel composition may have maximum amounts of oxygenates as specified in EN 228, for example methanol: 3.0% by volume, ethanol: 5.0% by volume, iso-propanol: 10.0% by volume, iso-butyl alcohol: 10.0% by volume, tert-butanol: 7.0% by volume, ethers ($C_5$ or higher): 10% by volume and other oxygenates (subject to suitable final boiling point): 10.0% by volume. The fuel composition may comprise ethanol complying with EN 15376 at a concentration of up to 5.0% by volume.

The fuel composition and the additive concentrate for a fuel composition suitable for use in a spark-ignition internal combustion engine may further comprise at least one friction modifier other than the at least one long chain fatty acid ester. Such other friction modifiers include compounds described herein as friction modifiers for lubricant compositions and additive concentrates for lubricant compositions.

The fuel composition and the additive concentrate for a fuel composition suitable for use in a spark-ignition internal combustion engine may further comprise independently one or more detergent, one or more octane improver, one or more friction modifier, one or more anti-oxidant, one or more valve seat recession additive, one or more corrosion inhibitor, one or more anti-static agent, one or more odorant, one or more colorant, one or more marker and/or combinations of one or more thereof.

The additive concentrate for a fuel composition for a spark-ignition internal combustion engine may comprise solvent. Suitable solvents include polyethers and aromatic and/or aliphatic hydrocarbons, for example heavy naphtha e.g. Solvesso (Trade mark), xylenes and kerosine.

Suitable detergents include poly isobutylene amines (PIB amines) and polyether amines.

Suitable octane improvers include N-methyl aniline, methyl cyclopentadienyl manganese tricarbonyl (MMT) (for example present at a concentration of up to 120 ppm by weight), ferrocene (for example present at a concentration of up to 16 ppm by weight) and tetra ethyl lead (for example present at a concentration of up to 0.7 g/l, e.g. up to 0.15 g/l).

Suitable anti-oxidants include phenolic anti-oxidants (for example 2,4-di-tert-butylphenol and 3,5-di-tert-butyl-4-hydroxyphenylpropionic acid) and aminic anti-oxidants (for example para-phenylenediamine, dicyclohexylamine and derivatives thereof).

Suitable corrosion inhibitors include ammonium salts of organic carboxylic acids, amines and heterocyclic aromatics, for example alkylamines, imidazolines and tolyltriazoles.

Valve seat recession additives may be present at a concentration of up to 15000 ppm by weight, for example up to 7500 ppm by weight.

The representative suitable and more suitable independent amounts of additives (if present) in the fuel composition suitable for a spark-ignition engine are given in Table 4. The concentrations expressed in Table 4 are by weight of active additive compounds that is, independent of any solvent or diluent.

The additives in the fuel composition suitable for use in spark-ignition internal combustion engines are suitably present in a total amount in the range of 20 to 25000 ppm by weight. Therefore, the concentrations of each additive in an additive concentrate will be correspondingly higher than in the fuel composition, for example by a ratio of 1:0.00002 to 0.025. The additives may be used as part-packs, for example part of the additives (sometimes called refinery additives) being added at the refinery during manufacture of a fungible fuel and part of the additives (sometimes called terminal or marketing additives) being added at a terminal of distribution point. The at least one long chain fatty acid ester may suitably be added or used as a refinery or marketing additive, preferably as a marketing additive for example at a terminal or distribution point.

TABLE 4

| | Fuel composition for spark-ignition internal combustion engine | |
|---|---|---|
| Additive type | Suitable amount (actives), if present (ppm by weight) | More suitable amount (actives), if present (ppm by weight) |
| Long chain fatty acid ester of a hydroxy carboxylic acid in which the long chain fatty acid has at least 4 carbon atoms and the ester is an oil-soluble ester of a mono- or poly- hydroxy carboxylic acid having 1 to 4 groups which are independently carboxylic acid groups or lower hydrocarbyl esters thereof and in which, when the hydroxy carboxylic acid is a mono-hydroxy carboxylic acid, the ester | 20 to 500 | 20 to 200 |

TABLE 4-continued

| Additive type | Fuel composition for spark-ignition internal combustion engine | |
|---|---|---|
| | Suitable amount (actives), if present (ppm by weight) | More suitable amount (actives), if present (ppm by weight) |
| has a long chain fatty acid ester moiety of the hydroxy group of the hydroxy carboxylic acid and, when the hydroxy carboxylic acid is a poly-hydroxy carboxylic acid, the ester has independently long chain fatty acid ester moieties of one or two of the hydroxy groups of the poly-hydroxy carboxylic acid | | |
| Friction modifiers other than the long chain fatty acid esters above | 10 to 500 | 25 to 150 |
| Detergents | 10 to 2000 | 50 to 300 |
| Octane improvers | 50 to 20000 | |
| Anti-oxidants | 1 to 100 | 10 to 50 |
| Anti-static agents | 0.1 to 5 | 0.5 to 2 |

The invention will now be described by way of example only with reference to the following experiments and examples in which examples according to the present invention are labelled numerically as Example 1, Example 2 etc. and experiments not according to the present invention are labelled alphabetically as Experiment A, Experiment B etc.

Preparation of Triethyl Citrate Oleate.

A solution of triethyl citrate (0.87 g, 1 equivalent) in tetrahydrofuran (THF) was added to a solution of sodium hydride (0.2 g, 1.5 equivalents) in THF at 0° C. and stirred at 0° C. for 1 hour. Then oleoyl chloride (0.87 g, 1 equivalent) was added and stirred for 1 hour at 0° C. under nitrogen atmosphere. The mixture was stirred at 25-30° C. for 8 hours. Thin layer chromatography analysis indicated that the reaction was complete. The mixture was quenched with cold water and extracted with ethyl acetate. The ethyl acetate phase was washed with sodium bicarbonate solution (10%) followed by water and then brine solution. The resulting mixture was dried over sodium sulphate and concentrated to obtain a crude product. Purified product was obtained from the crude product by column chromatography using 10% petroleum ether in ethyl acetate as eluent. Yield of product was 0.6 g.

Preparation of Lubricant Compositions.

A 5W-30 lubricant composition (Lubricant A) was prepared to model a typical lubricant composition suitable for passenger cars with either compression-ignition or spark-ignition internal combustion engines, but having a lower ZDDP content than a typical lubricant. The lubricant composition was made by admixing additives as in a commercially available additive package containing dispersant, detergent, antioxidant, antifoam and ZDDP (but with reduced amount of ZDDP) with a Group III base oil, a pour point depressant, viscosity modifier and dispersant viscosity modifier.

A lubricant composition (Lubricant 1) according to the present invention was prepared in the same way as Lubricant A, but with 2% by weight triethyl citrate oleate prepared as described above. 2% by weight triethyl citrate oleate is a concentration comparable on a molar basis to 1% by weight triethyl citrate because the molecular weights of these two compounds are 540.73 and 276.28 respectively.

Several other lubricant compositions (Lubricants B to D) were prepared as Lubricant 1 but with friction modifiers/anti-wear additives other than triethyl citrate oleate as indicated below. Thus, Lubricant B used glycerol monooleate (HiTEC® 7133), Lubricant C used triethyl citrate and Lubricant D used Sakura-lube 165, the active component of which is which is molybdenum dithiocarbamate (MoDTC).

Lubricants A to D are not according to the present invention because the lubricant compositions do not contain any long chain fatty acid ester of a hydroxy carboxylic acid in which the long chain fatty acid has at least 4 carbon atoms and the ester is an oil-soluble ester of a mono- or poly-hydroxy carboxylic acid having 1 to 4 groups which are independently carboxylic acid groups or lower hydrocarbyl esters thereof and in which, when the hydroxy carboxylic acid is a mono-hydroxy carboxylic acid, the ester has a long chain fatty acid ester moiety of the hydroxy group of the hydroxy carboxylic acid and, when the hydroxy carboxylic acid is a poly-hydroxy carboxylic acid, the ester has independently long chain fatty acid ester moieties of one or two of the hydroxy groups of the poly-hydroxy carboxylic acid. Lubricant 1 is according to the present invention.

All the lubricant compositions had a ZDDP content corresponding to 0.0285% by weight phosphorus.

1. Wear Testing of Lubricant Compositions.

Thin layer activation (TLA) wear tests were undertaken for Lubricants A to D and Lubricant 1.

The TLA wear test is a radio nucleotide wear test used to simulate cam follower wear in an engine. Wearing components were radioactively activated and the rate at which radioactive metal was worn off and accumulated in the oil was measured to assess the wear in nm/h. The results for the tests performed at 40° C., are shown in Table 5. Experiments A to D are not according to the present invention because the lubricant compositions do not contain at least one long chain fatty acid ester. Example 1 is according to the present invention.

The results in Table 5 show that the long chain fatty acid ester of a hydroxy carboxylic acid in which the long chain fatty acid has at least 4 carbon atoms and the ester is an oil-soluble ester of a mono- or poly-hydroxy carboxylic acid having 1 to 4 groups which are independently carboxylic acid groups or lower hydrocarbyl esters thereof and in which, when the hydroxy carboxylic acid is a mono-hydroxy carboxylic acid, the ester has a long chain fatty acid ester moiety of the hydroxy group of the hydroxy carboxylic acid and, when the hydroxy carboxylic acid is a poly-hydroxy carboxylic acid, the ester has independently long chain fatty acid ester moieties of one or two of the hydroxy groups of the poly-hydroxy carboxylic acid and in particular a long chain fatty acid (e.g. oleic acid) ester of a hydroxy carboxylic acid having lower hydrocarbyl (e.g. ethyl) esters of 3 carboxylic acid groups (e.g. triethyl citric acid), for example triethyl citrate oleate, exhibits good anti-wear properties when used in a lubricant composition, for example when used in combination with a low concentration of zinc dihydrocarbyl dithiophosphates (ZDDP), for example corresponding to 285 ppm phosphorus.

TABLE 5

| | Lubricant | Additive | Treat rate of anti-wear additive (wt. %) | Wear rate (nm/h) | Wear reduction compared to Experiment A |
|---|---|---|---|---|---|
| Expt. A | A | — | — | 98.9 | — |
| Example 1 | 1 | triethyl citrate oleate | 2% | 45.1 | 54.4% |
| Expt. B | B | Glycerol mono-oleate (GMO) | 0.5% | 39.6 | 60.0% |
| Expt. C | C | Triethyl citrate | 1% | 37.1 | 62.5% |
| Expt. D | D | Sakura-lube 165 | 1% (450 ppm Mo) | 28.7 | 71% |

2. Cameron Plint Wear Tests.

Cameron Plint wear tests were undertaken for lubricants with the same compositions as those used in the previously-described tests.

The Cameron Plint rig wear test was used to simulate reciprocating boundary friction and produce wear at higher temperatures (100° C.). The apparatus was set up in a pin on plate configuration. The pin was reciprocated along the plate at a frequency of 25 Hz, stroke length of 2.3 min and with an applied pressure of 150N. Oil was fed into the contact area at a rate of 3 ml/hr. Standard steel B01 Flat Plate and EN31 Roller plint components were used in these tests. The results from 21 hour tests are shown in Table 6. Experiments E to H are not according to the present invention because the lubricant compositions do not contain any long chain fatty acid ester of a hydroxy carboxylic acid in which the long chain fatty acid has at least 4 carbon atoms and the ester is an oil-soluble ester of a mono- or poly-hydroxy carboxylic acid having 1 to 4 groups which are independently carboxylic acid groups or lower hydrocarbyl esters thereof and in which, when the hydroxy carboxylic acid is a mono-hydroxy carboxylic acid, the ester has a long chain fatty acid ester moiety of the hydroxy group of the hydroxy carboxylic acid and, when the hydroxy carboxylic acid is a poly-hydroxy carboxylic acid, the ester has independently long chain fatty acid ester moieties of one or two of the hydroxy groups of the poly-hydroxy carboxylic acid. Example 2 is according to the present invention.

TABLE 6

| | Lubricant | Additive | Treat rate of anti-wear additive (wt. %) | Wear volume ($m^3$/Nm) | Wear reduction compared to Experiment E |
|---|---|---|---|---|---|
| Expt. E | A | — | — | $5.71 \times 10^{-17}$ | — |
| Example 2 | 1 | Triethyl citrate oleate | 2% | $2.48 \times 10^{-18}$ | 95.7% |

TABLE 6-continued

| | Lubricant | Additive | Treat rate of anti-wear additive (wt. %) | Wear volume ($m^3$/Nm) | Wear reduction compared to Experiment E |
|---|---|---|---|---|---|
| Expt. F | B | Glycerol mono-oleate (GMO) | 0.5% | $6.11615 \times 10^{-18}$ | 89.3% |
| Expt. G | C | Triethyl citrate | 1% | $2.96357 \times 10^{-18}$ | 94.8% |
| Expt. H | D | Sakura-lube 165 | 1% (450 ppm Mo) | $2.5002 \times 10^{-18}$ | 95.6% |

The results in Table 6 show that the long chain fatty acid ester of a hydroxy carboxylic acid in which the long chain fatty acid has at least 4 carbon atoms and the ester is an oil-soluble ester of a mono- or poly-hydroxy carboxylic acid having 1 to 4 groups which are independently carboxylic acid groups or lower hydrocarbyl esters thereof and in which, when the hydroxy carboxylic acid is a mono-hydroxy carboxylic acid, the ester has a long chain fatty acid ester moiety of the hydroxy group of the hydroxy carboxylic acid and, when the hydroxy carboxylic acid is a poly-hydroxy carboxylic acid, the ester has independently long chain fatty acid ester moieties of one or two of the hydroxy groups of the poly-hydroxy carboxylic acid and in particular a long chain fatty acid (e.g. oleic acid) ester of a hydroxy carboxylic acid having lower hydrocarbyl (e.g. ethyl) esters of 3 carboxylic acid groups (e.g. triethyl citric acid), for example triethyl citrate oleate, exhibits good anti-wear properties when used in a lubricant composition, for example when used in combination with a low concentration of zinc dihydrocarbyl dithiophosphates (ZDDP), for example corresponding to 285 ppm phosphorus.

3. Four-Ball Wear Tests.

Four-Ball wear tests according to ASTM D 4172 but modified to test mild and hence discriminating conditions of 30 kg and 60 minutes were undertaken for lubricants with the same compositions as those used in the previously-described tests. In the 4 ball wear test, one ball bearing was rotated above a cradle of three others in the presence of a lubricant. The results are shown in Table 7. Experiments I to L are not according to the present invention because the lubricant compositions do not contain any long chain fatty acid ester of a hydroxy carboxylic acid in which the long chain fatty acid has at least 4 carbon atoms and the ester is an oil-soluble ester of a mono- or poly-hydroxy carboxylic acid having 1 to 4 groups which are independently carboxylic acid groups or lower hydrocarbyl esters thereof and in which, when the hydroxy carboxylic acid is a mono-hydroxy carboxylic acid, the ester has a long chain fatty acid ester moiety of the hydroxy group of the hydroxy carboxylic acid and, when the hydroxy carboxylic acid is a poly-hydroxy carboxylic acid, the ester has independently long chain fatty acid ester moieties of one or two of the hydroxy groups of the poly-hydroxy carboxylic acid. Example 3 is according to the present invention.

TABLE 7

| | Lubricant Comp. | Additive | Treat rate of anti-wear additive (wt. %) | Mean wear scar diameter (mm) | Wear reduction compared to Experiment I |
|---|---|---|---|---|---|
| Expt. I | A | — | — | 0.447 | — |
| Example 3 | 1 | Triethyl citrate oleate | 2% | 0.414 | 7.4% |
| Expt. J | B | Glycerol monoleate (GMO) | 0.5% | 0.302 | 32.4% |
| Expt. K | C | Triethyl citrate | 1% | 0.346 | 22.6% |
| Expt. L | D | Sakura-lube 165 | 1% (450 ppm Mo) | 0.387 | 13.4% |

The results in Table 7 show that the long chain fatty acid ester of a hydroxy carboxylic acid in which the long chain fatty acid has at least 4 carbon atoms and the ester is an oil-soluble ester of a mono- or poly-hydroxy carboxylic acid having 1 to 4 groups which are independently carboxylic acid groups or lower hydrocarbyl esters thereof and in which, when the hydroxy carboxylic acid is a mono-hydroxy carboxylic acid, the ester has a long chain fatty acid ester moiety of the hydroxy group of the hydroxy carboxylic acid and, when the hydroxy carboxylic acid is a poly-hydroxy carboxylic acid, the ester has independently long chain fatty acid ester moieties of one or two of the hydroxy groups of the poly-hydroxy carboxylic acid and in particular a long chain fatty acid (e.g. oleic acid) ester of a hydroxy carboxylic acid having lower hydrocarbyl (e.g. ethyl) esters of 3 carboxylic acid groups (e.g. triethyl citric acid), for example triethyl citrate oleate, exhibits anti-wear properties when used in a lubricant composition, for example when used in combination with a low concentration of zinc dihydrocarbyl dithiophosphates (ZDDP), for example corresponding to 285 ppm phosphorus.

4. HFRR Friction Tests.

A High Frequency Reciprocating Rig friction test was undertaken for lubricants with the same compositions as those used in the previously-described tests.

The HFRR test is usually used to assess lubricity of diesel fuels (according to ASTM D6079-97). It may also be used to assess friction coefficients between sliding solid surfaces in the presence of lubricant compositions with various friction modifiers over a temperature range and hence the test may be used to assess the performance of the friction modifiers.

The results are shown in Table 8. Experiments M to P are not according to the present invention because the lubricant compositions do not contain any long chain fatty acid ester of a hydroxy carboxylic acid in which the long chain fatty acid has at least 4 carbon atoms and the ester is an oil-soluble ester of a mono- or poly-hydroxy carboxylic acid having 1 to 4 groups which are independently carboxylic acid groups or lower hydrocarbyl esters thereof and in which, when the hydroxy carboxylic acid is a mono-hydroxy carboxylic acid, the ester has a long chain fatty acid ester moiety of the hydroxy group of the hydroxy carboxylic acid and, when the hydroxy carboxylic acid is a poly-hydroxy carboxylic acid, the ester has independently long chain fatty acid ester moieties of one or two of the hydroxy groups of the poly-hydroxy carboxylic acid. Example 4 is according to the present invention.

TABLE 8

| | Lubricant Comp. | Additive | FC 40° C. | FC 140° C. | Average FC | Reduction of average FC |
|---|---|---|---|---|---|---|
| Expt. M | A | — | 0.138 | 0.159 | 0.145 | — |
| Example 4 | 1 | Triethyl citrate oleate | 0.124 | 0.117 | 0.128 | 11.7% |
| Expt. N | B | Glycerol monooleate (GMO) | 0.129 | 0.118 | 0.124 | 14.5% |
| Expt. O | C | Triethyl citrate | 0.134 | 0.15 | 0.143 | 1.4% |
| Expt. P | D | Sakura-lube 165 | 0.137 | 0.113 | 0.121 | 16.6% |

Note:
FC = friction coefficient

The results in Table 8 show that the long chain fatty acid ester of a hydroxy carboxylic acid in which the long chain fatty acid has at least 4 carbon atoms and the ester is an oil-soluble ester of a mono- or poly-hydroxy carboxylic acid having 1 to 4 groups which are independently carboxylic acid groups or lower hydrocarbyl esters thereof and in which, when the hydroxy carboxylic acid is a mono-hydroxy carboxylic acid, the ester has a long chain fatty acid ester moiety of the hydroxy group of the hydroxy carboxylic acid and, when the hydroxy carboxylic acid is a poly-hydroxy carboxylic acid, the ester has independently long chain fatty acid ester moieties of one or two of the hydroxy groups of the poly-hydroxy carboxylic acid and in particular a long chain fatty acid (e.g. oleic acid) ester of a hydroxy carboxylic acid having lower hydrocarbyl (e.g. ethyl) esters of 3 carboxylic acid groups (e.g. triethyl citric acid), for example triethyl citrate oleate, exhibits good friction modifier properties in a lubricant composition, for example when used in combination with a low concentration of zinc dihydrocarbyl dithiophosphates (ZDDP), for example corresponding to 285 ppm phosphorus. The friction modifier performance of the triethyl citrate oleate was significantly better than the performance of triethyl citrate when used at comparable molar concentrations.

The results in Table 8 also indicate that the long chain fatty acid ester of a hydroxy carboxylic acid in which the long chain fatty acid has at least 4 carbon atoms and the ester is an oil-soluble ester of a mono- or poly-hydroxy carboxylic acid having 1 to 4 groups which are independently carboxylic acid groups or lower hydrocarbyl esters thereof and in which, when the hydroxy carboxylic acid is a mono-hydroxy carboxylic acid, the ester has a long chain fatty acid ester moiety of the hydroxy group of the hydroxy carboxylic acid and, when the hydroxy carboxylic acid is a poly-hydroxy carboxylic acid, the ester has independently long chain fatty acid ester moieties of one or two of the hydroxy groups of the poly-hydroxy carboxylic acid and in particular a long chain fatty acid (e.g. oleic acid) ester of a hydroxy carboxylic acid having lower hydrocarbyl (e.g. ethyl) esters of 3 carboxylic acid groups (e.g. triethyl citric acid), for example triethyl citrate oleate, may be used as a friction modifier in a non-aqueous lubricating oil composition, for example as a crankcase lubricating oil composition for an internal combustion engine and/or in a fuel composition for an internal combustion engine, for example a fuel composition for a compression-ignition engine.

FURTHER EXPERIMENTS AND EXAMPLES

Preparation of Triethyl Citrate Butyrate.

To a solution of sodium hydride (0.651 g, 1.5 eq) in THF at 0° C., triethyl citrate (5 g, 1 eq) in THF (50 ml) was added drop wise and stirred for 1 h at 0° C. Then butaryl chloride (2.12 g, 1.1 eq) was added drop wise and stirred for 1 h at 0° C. under nitrogen atmosphere. The stirring was continued for another 12 h at 25-30° C. The reaction was monitored by thin layer chromatography. The reaction was quenched with cold water and extracted with ethyl acetate. Ethyl acetate layer was washed with sodium bicarbonate solution (10%) followed by water and brine solution. The organic layer was dried over sodium sulphate and concentrated to get the crude product. The crude product was purified by column chromatography using 6% ethyl acetate in petroleum ether as eluent. The product was characterized by NMR. Yield was 3 g; 48.6%.

Preparation of Triethyl Citrate Octanoate.

The same procedure was used as for preparation of triethyl citrate butyrate but using octyl chloride.

Preparation of Triethyl Citrate Myristate.

The same procedure was used as for preparation of triethyl citrate butyrate but using myristryl chloride.

Preparation of Diethyl Tartrate Dibutyrate

To a solution of sodium hydride (0.8712 g, 1.5 eq) in THF at 0° C., diethyl tartarate (5 g, 1 eq) in THF (50 ml) was added drop wise and stirred for 1 h at 0° C. Then butaryl chloride (7335 g, 3 eq) was added drop wise and stirred for 1 h at 0° C. under nitrogen atmosphere. The stirring was continued for another 12 h at 25-30° C. The reaction was monitored by thin layer chromatography. The reaction was quenched with cold water and extracted with ethyl acetate. Ethyl acetate layer was washed with sodium bicarbonate solution (10%) followed by water and brine solution. The organic layer was dried over sodium sulphate and concentrated to get the crude product. The crude product was purified by the column chromatography using 7% ethyl acetate in petroleum ether as eluent. The product was characterized by NMR. The yield was 3.2 g; 38.5%.

Preparation of Lubricant Compositions.

The esters prepared above, were formulated into lubricating compositions in combination with an additive package (10.21 wt %), which contained a conventional non-borated dispersant, calcium sulfonate and phenate detergents, phenolic and aminic anti oxidants, anti foam and Group III base oil. The lubricant compositions also comprised ZDDP at a treat rate corresponding to 400 ppm phosphorus, a viscosity modifier (4%) and a mixture of Yubase 4 and 6 base oils.

The lubricant compositions were prepared to have the same ester additive concentration (when present) on a molar basis, of 0.036 $molL^{-1}$ Wear Testing The lubricant compositions prepared above were tested in a Cameron Plint wear test using the same procedure as described in section 2 above except that the test duration was 21 hours. The results are set out in Table 9 below.

Friction Coefficient Testing.

The lubricant compositions prepared above were tested in an HFRR test in the same way as described in section 4 above, except that the results were reported as an average of readings taken at the end of each of 15 minute operating periods at each of three testing temperatures of 60, 90 and 120° C. The results are set out in Table 9 below.

The results in Table 9 show that the esters according to the present invention exhibit anti-wear properties.

The results in Table 9 also show that the esters according to the present invention exhibit friction modifying properties. In particular, for the triethyl citrate esters, the friction modifying properties appear to exhibit a peak in performance with increasing chain length of the long chain fatty acid with a peak at or around a carbon chain length of 14 carbon atoms.

The results in Table 9 also show that the friction modifier properties of the diethyl tartrate dibutyrate are superior to diethyl tartrate and diethyl tartrate diacetate

TABLE 9

| | Additive | Wear volume ($m^3$/Nm) | Reduction in wear volume compared to Expt. Q (%) | Average Friction Coefficient | Reduction of average friction coefficient compared to Expt. Q (%) |
|---|---|---|---|---|---|
| Expt. Q | None (400 ppm P) | $1.59 \times 10^{-17}$ | — | 0.16 | — |
| Expt. R | Triethyl citrate (1.00 wt %) | $2.75 \times 10^{-18}$ | 82.68 | 0.15 | 4.13 |
| Expt. S | Triethyl citrate acetate (1.15 wt %) | $2.45 \times 10^{-18}$ | 84.57 | 0.15 | 4.25 |
| Example 5 | Triethyl citrate oleate (1.96 wt %) | $2.53 \times 10^{-18}$ | 84.05 | 0.14 | 11.39 |
| Example 6 | Triethyl citrate butyrate (1.25 wt %) | $2.48 \times 10^{-18}$ | 84.36 | 0.15 | 3.19 |
| Example 7 | Triethyl citrate octanoate (1.46 wt %) | $2.89 \times 10^{-18}$ | 81.80 | 0.14 | 12.97 |
| Example 8 | Triethyl citrate myristate (1.76 wt %) | $2.90 \times 10^{-18}$ | 81.70 | 0.13 | 19.93 |
| Expt. T | Sakuralube 165 @ 1% | $2.53 \times 10^{-18}$ | 84.07 | 0.12 | 27.38 |
| Expt. U | GMO @ 0.5% | | | 0.13 | 21.58 |
| Expt. V | Diethyl tartrate (0.75 wt %) | $3.10 \times 10^{-18}$ | 80.46 | 0.15 | 5.42 |
| Expt. W | Diethyl tartrate diacetate (1.05 wt %) | $3.40 \times 10^{-18}$ | 78.58 | 0.16 | 2.99 |
| Example 9 | Diethyl tartrate dibutyrate (1.25 wt %) | $3.53 \times 10^{-18}$ | 77.78 | 0.15 | 8.85 |
| Expt. X | Blank (285 ppm P) | $6.84 \times 10^{-18}$ | 59.16 | 0.16 | 2.66 |
| Example 10 | Triethyl citrate oleate at 285 ppm P | $2.24 \times 10^{-18}$ | 85.87 | 0.14 | 15.19 |

The invention claimed is:

1. A non-aqueous lubricant composition comprising a major amount of an oil of lubricating viscosity and a minor amount of at least one compound, each compound being an oil-soluble long chain fatty acid ester of a mono- or di-hydroxy carboxylic acid selected from citric acid, malic acid and tartaric acid, wherein:

(i) when the compound is an oil-soluble long chain fatty acid ester of a mono-hydroxy carboxylic acid, the compound includes a long chain fatty acyl moiety substituted at the hydroxy group of the mono-hydroxy carboxylic acid, the long-chain fatty acyl moiety having 8 to 22 carbon atoms, and each carboxylate of the mono-hydroxy carboxylic acid independently is a lower alkyl carboxylate ester, each lower alkyl carboxylate ester having an alkyl moiety which independently has 1 to 3 carbon atoms;

(ii) when the compound is an oil-soluble long chain fatty acid mono-ester of a di-hydroxy carboxylic acid, the compound includes a long chain fatty acyl moiety substituted at the hydroxy groups of the di-hydroxy carboxylic acid, the long-chain fatty acyl moiety having 8 to 22 carbon atoms, and each carboxylate of the di-hydroxy carboxylic acid independently is a lower alkyl carboxylate ester, each lower alkyl carboxylate ester having an alkyl moiety which independently has 1 to 3 carbon atoms; and (iii) when the compound is an oil-soluble long chain fatty acid di-ester of a di-hydroxy carboxylic acid, the compound includes two long chain fatty acyl moieties, each substituted at one of the hydroxy groups of the di-hydroxy carboxylic acid, each long-chain fatty acyl moiety independently having 8 to 22 carbon atoms, and each carboxylate of the di-hydroxy carboxylic acid independently is a lower alkyl carboxylate ester, each lower alkyl carboxylate ester having an alkyl moiety which independently has 1 to 3 carbon atoms.

2. The composition as claimed in claim 1, wherein each compound is an oil-soluble long chain fatty acid ester of citric acid, wherein:

each compound includes a long chain fatty acyl moiety substituted at the hydroxy group of the citric acid, the long-chain fatty acyl moiety having 8 to 22 carbon atoms, and each carboxylate of the citric acid independently is a lower alkyl carboxylate ester, each lower alkyl carboxylate ester having an alkyl moiety which independently has 1 to 3 carbon atoms.

3. The composition as claimed in claim 1 in which each compound is a long chain fatty acid di-ester of tartaric acid, wherein each compound includes two long chain fatty acyl moieties, each substituted at one of the hydroxy groups of the tartaric acid, each long-chain fatty acyl moiety independently having 8 to 22 carbon atoms, and each carboxylate of the tartaric acid is independently is a lower alkyl carboxylate ester, each lower alkyl carboxylate ester having an alkyl moiety which independently has 1 to 3 carbon atoms.

4. The composition as claimed in claim 1 in which each of the compounds is a long chain fatty acid mono-ester of tartaric acid, wherein the compound includes a long chain fatty acyl moiety substituted at only one of the hydroxy groups of the tartaric acid, the long-chain fatty acyl moiety having 8 to 22 carbon atoms, and each carboxylate of the tartaric acid independently is a lower alkyl carboxylate ester, each lower alkyl carboxylate ester having an alkyl moiety which independently has 1 to 3 carbon atoms.

5. The composition as claimed in claim 1 in which each of the long chain fatty acyl moieties has 8 to 18 carbon atoms.

6. The composition as claimed in claim 2 in which each of the long chain fatty acyl moieties has 8 to 18 carbon atoms.

7. The composition as claimed in claim 3 in which each of the long chain fatty acyl moieties has 8 to 18 carbon atoms.

8. The composition as claimed in claim 1 in which each of the long chain fatty acyl moieties has 14 to 22 carbon atoms.

9. The composition as claimed in claim 2 in which each of the long chain fatty acyl moieties has 14 to 22 carbon atoms.

10. The composition as claimed in claim 3 in which each of the long chain fatty acyl moieties has 14 to 22 carbon atoms.

11. The composition as claimed in claim 1 in which each of the long chain fatty acyl moieties has 8, 14, 16, 18 or 22 carbon atoms.

12. The composition as claimed in claim 1 in which the long chain fatty acyl moieties is oleoyl.

13. The composition as claimed in claim 1 in which the long chain fatty acyl moieties is myristoyl.

14. The composition as claimed in claim 1 in which the alkyl moieties of the lower alkyl carboxylate esters are ethyl.

15. The composition as claimed in claim 2 in which the alkyl moieties of the lower alkyl carboxylate esters are ethyl.

16. The composition as claimed in claim 3 in which the alkyl moieties of the lower alkyl carboxylate esters are ethyl.

17. The composition as claimed in claim 1, wherein each compound is derived from (a) reacting the mono- or di-hydroxy carboxylic acid and the long chain fatty acid or an acyl halide of the long chain fatty acid or (b) reacting a lower hydrocarbyl ester of the hydroxy carboxylic acid and the long chain fatty acid or an acyl halide of the long chain fatty acid.

18. The composition as claimed in claim 1, wherein each compound is an oil-soluble long chain fatty acid ester of citric acid, wherein:

each compound includes a long chain fatty acyl moiety substituted at the hydroxy group of the citric acid, the long-chain fatty acyl moiety having 8 to 18 carbon atoms, and each carboxylate of the citric acid independently is a lower alkyl carboxylate ester, each lower alkyl carboxylate ester having an alkyl moiety which is ethyl.

19. The composition as claimed in claim 1, wherein each compound is an oil-soluble long chain fatty acid ester of citric acid, wherein:

each compound includes a long chain fatty acyl moiety substituted at the hydroxy group of the citric acid, the long-chain fatty acyl moiety having 14 to 22 carbon atoms, and each carboxylate of the citric acid independently is a lower alkyl carboxylate ester, each lower alkyl carboxylate ester having an alkyl moiety which is ethyl.

20. The composition as claimed in claim 1, wherein each compound is an oil-soluble long chain fatty acid mono- or di-ester of tartaric acid, wherein in which the oil soluble ester has the structural formula:

when the compound is an oil-soluble long chain fatty acid mono-ester of tartaric acid, the compound includes a long chain fatty acyl moiety substituted at only one of the hydroxy groups of the tartaric acid, the long-chain fatty acyl moiety having 8 to 22 carbon atoms, and each carboxylate of the tartaric acid independently is a lower alkyl carboxylate ester, each lower alkyl carboxylate ester having an alkyl moiety which independently has 1 to 3 carbon atoms; and when the compound is an oil-soluble long chain fatty acid di-ester of tartaric acid, the compound includes two long chain fatty acyl moieties, each substituted at one of the hydroxy groups of the tartaric acid, each long-chain fatty acyl moiety independently having 8 to 22 carbon atoms, and each carboxylate of the tartaric acid independently is a lower alkyl carboxylate ester, each lower alkyl carboxylate ester having an alkyl moiety which independently has 1 to 3 carbon atoms.

21. The composition as claimed in claim 20, wherein each alkyl moiety of each lower alkyl carboxylate ester is ethyl.

22. The composition as claimed in claim 21, wherein each long chain fatty acyl moiety independently has 8 to 18 carbon atoms.

23. The composition as claimed in claim 21, wherein each long chain fatty acyl moiety independently has 14 to 22 carbon atoms.

24. The composition as claimed in claim 1, wherein each compound is an oil-soluble long chain fatty acid ester of malic acid, wherein each compound includes a long chain fatty acyl moiety substituted at the hydroxy group of the malic acid, the long-chain fatty acyl moiety having 8 to 22 carbon atoms, and each carboxylate of the malic acid independently is a lower alkyl carboxylate ester, each lower alkyl carboxylate ester having an alkyl moiety which independently has 1 to 3 carbon atoms.

* * * * *